US008607552B2

(12) United States Patent
Ikemoto et al.

(10) Patent No.: US 8,607,552 B2
(45) Date of Patent: Dec. 17, 2013

(54) EMISSION CONTROL SYSTEM WITH HEAT RECOVERY DEVICE

(75) Inventors: Noriaki Ikemoto, Kariya (JP); Tubasa Sakuishi, Oobu (JP); Hisashi Iida, Kariya (JP); Naoyuki Kamiya, Kariya (JP)

(73) Assignee: Denso Corporation, Kariya (JP)

( * ) Notice: Subject to any disclaimer, the term of this patent is extended or adjusted under 35 U.S.C. 154(b) by 566 days.

(21) Appl. No.: 12/902,498

(22) Filed: Oct. 12, 2010

(65) Prior Publication Data

US 2011/0083426 A1 Apr. 14, 2011

(30) Foreign Application Priority Data

Oct. 12, 2009 (JP) ..... 2009-235814
Mar. 22, 2010 (JP) ..... 2010-065345
Mar. 22, 2010 (JP) ..... 2010-065346

(51) Int. Cl.
*F01N 3/00* (2006.01)

(52) U.S. Cl.
USPC ..... 60/297; 60/286

(58) Field of Classification Search
USPC ..... 60/297
See application file for complete search history.

(56) References Cited

U.S. PATENT DOCUMENTS 6,253,548 B1 7/2001 Ap et al.
6,327,852 B1 12/2001 Hirose
7,832,204 B2 * 11/2010 Bidner et al. ..... 60/320
8,122,706 B2 * 2/2012 Yoshida et al. ..... 60/285
2001/0002538 A1 6/2001 Katsuta et al.
2009/0308059 A1 * 12/2009 Ikemoto ..... 60/287
2010/0146943 A1 * 6/2010 Muramatsu et al. ..... 60/286

FOREIGN PATENT DOCUMENTS

JP 11-218020 8/1999
JP 11-343832 12/1999
JP 2000-265823 9/2000
JP 2000-274227 10/2000
JP 2001-164930 6/2001
JP 2004-116370 4/2004
JP 2005016364 A * 1/2005 ..... F01P 7/16
JP 2009127512 A * 6/2009

OTHER PUBLICATIONS

English translation of Japanese Patent Application Publication No. JP 2005016364 A.*

* cited by examiner

*Primary Examiner* — Thomas Denion
*Assistant Examiner* — Jason Shanske
(74) *Attorney, Agent, or Firm* — Nixon & Vanderhye P.C.

(57) ABSTRACT

In an emission control system, an absorbent in an exhaust-emission passage absorbs a particular component in the emission with a temperature thereof being lower than a first temperature, and desorbs therefrom the absorbed particular component with the temperature thereof being equal to or higher than the first temperature. A catalyst in the exhaust-emission passage converts the particular component desorbed from the absorbent into another component with a temperature thereof being equal to or higher than a second temperature higher than the first temperature. A heat recovery device is disposed in the exhaust-emission passage upstream of the absorbent and recovers heat from the exhaust emission by heat exchange between a heat-transfer medium and the exhaust emission. An adjusting unit adjusts an amount of heat to be recovered by the heat recovery device to thereby adjust a temperature state of the exhaust emission.

17 Claims, 14 Drawing Sheets

EMISSION CONTROL SYSTEM WITH HEAT RECOVERY DEVICE

CROSS REFERENCE TO RELATED APPLICATIONS

This application is based on Japanese Patent Applications 2009-235814, 2010-65345, and 2010-65346 filed on Oct. 12, 2009, Mar. 22, 2010, and Mar. 22, 2010, respectively. This application claims the benefit of priority from the Japanese Patent Application, so that the descriptions of which are all incorporated herein by reference.

FIELD OF THE INVENTION

The present invention relates to emission control systems designed to absorb, by an absorbent, particular components in the exhaust emissions from an internal combustion engine, and to oxidize or reduce, by a catalyst, the particular components desorbed from the absorbent.

BACKGROUND OF THE INVENTION

Emission control is one of the important technologies installed in modern motor vehicles. Emission control systems are designed to implement such emission control. Specifically, these emission control systems are commonly used for minimizing these particular components contained in the exhaust emissions from the internal combustion engine (engine) as by-products of combustion leaving the engine.

An absorbent for absorbing hydrocarbons (HC) as one of the main particular components in the exhaust emissions is normally used in the emission control system. Specifically, this absorbent is characterized to absorb the HC with its temperature lower than a desorbing temperature T1, and desorb the absorbed HC with its temperature equal to or higher than the desorbing temperature T1. An oxidation catalyst for oxidizing HC is also normally used in the emission control system. Specifically, this oxidation catalyst is characterized to activate with its temperature equal to or higher than an activation temperature T2. In the activated state, the oxidation catalyst enables the HC desorbed from the absorbent to be oxidized. Note that the activation temperature T2 is usually set to be higher than the desorbing temperature T1.

Japanese Patent Application Publications No. 2004-116370 and 2001-164930 disclose, at cold start of the engine, control for retarding engine ignition timing to raise the temperature of the oxidation catalyst up to the activation temperature T2 early after the start-up of the engine. This control to raise the temperature of the catalyst including the ignition-timing retard control will also be referred to as "catalyst warm-up control".

If the catalyst warm-up control were executed immediately after start-up of the engine, the temperature of the absorbent for the HC would be equal to or higher than the desorbing temperature T1 with the amount of the absorbed HC being not up to a given saturated amount thereof. This could not make full use of the absorption capabilities of the absorbent.

In order to address this problem, an emission control system disclosed in the Patent Publication No. 2004-116370 is configured to start the catalyst warm-up control at the time when the absorption temperature reaches the desorbing temperature T1.

SUMMARY OF THE INVENTION

The inventors have discovered that there are problems in the emission control system disclosed in the Patent Publication No. 2004-116370.

Specifically, because the emission control system disclosed in the Patent Publication No. 2004-116370 is to retard engine ignition timing in order to warm the oxidation catalyst up to its activation temperature, the retard of the engine ignition timing may reduce fuel economy. This problem can be caused in another emission control system for absorbing another component, such as oxides of nitrogen (NOx), and reducing the absorbed component in the same manner as the emission control system disclosed in the Patent Publication No. 2004-116370.

In view of the circumstances set forth above, the present invention seeks to provide emission control systems for internal combustion engines, each of which is designed to solve these problems set forth above, and more specifically, to early complete the catalyst warm-up control with little effect on the performance of a corresponding internal combustion engine.

For example, one type of these emission control systems is designed to early complete the catalyst warm-up control while maintaining fuel economy.

According to one aspect of the present invention, there is provided an emission control system. The emission control system includes an absorbent provided in a passage through which an exhaust emission of an internal combustion engine flows. The exhaust emission contains a particular component. The absorbent acts to absorb the particular component with a temperature thereof being lower than a first temperature. The absorbent acts to desorb therefrom the absorbed particular component with the temperature thereof being equal to or higher than the first temperature. The emission control system includes a catalyst provided in the passage. The catalyst acts to convert the particular component desorbed from the absorbent into another component with a temperature thereof being equal to or higher than a second temperature, the second temperature being higher than the first temperature. The emission control system includes a heat recovery device disposed in the passage upstream of the absorbent and configured to recover heat from the exhaust emission by heat exchange between a heat-transfer medium and the exhaust emission. The emission control system includes an adjusting unit configured to adjust an amount of heat to be recovered by the heat recovery device to thereby adjust a temperature state of the exhaust emission.

With the configuration of this one aspect of the present invention, adjustment of the amount of heat to be recovered by the heat recovery device allows adjustment of the temperature state of the exhaust emission, which, for example, enters the absorbent and the catalyst. That is, the adjustment of the amount of heat to increase it allows early completion of catalyst warm-up control without retarding an ignition timing for the internal combustion engine, thus making it possible to early complete the catalyst warm-up control with no or little effect on the performance of the internal combustion engine.

BRIEF DESCRIPTION OF THE DRAWINGS

Other objects and aspects of the invention will become apparent from the following description of embodiments with reference to the accompanying drawings in which.

DETAILED DESCRIPTION OF EMBODIMENTS OF THE INVENTION

Figure 1:
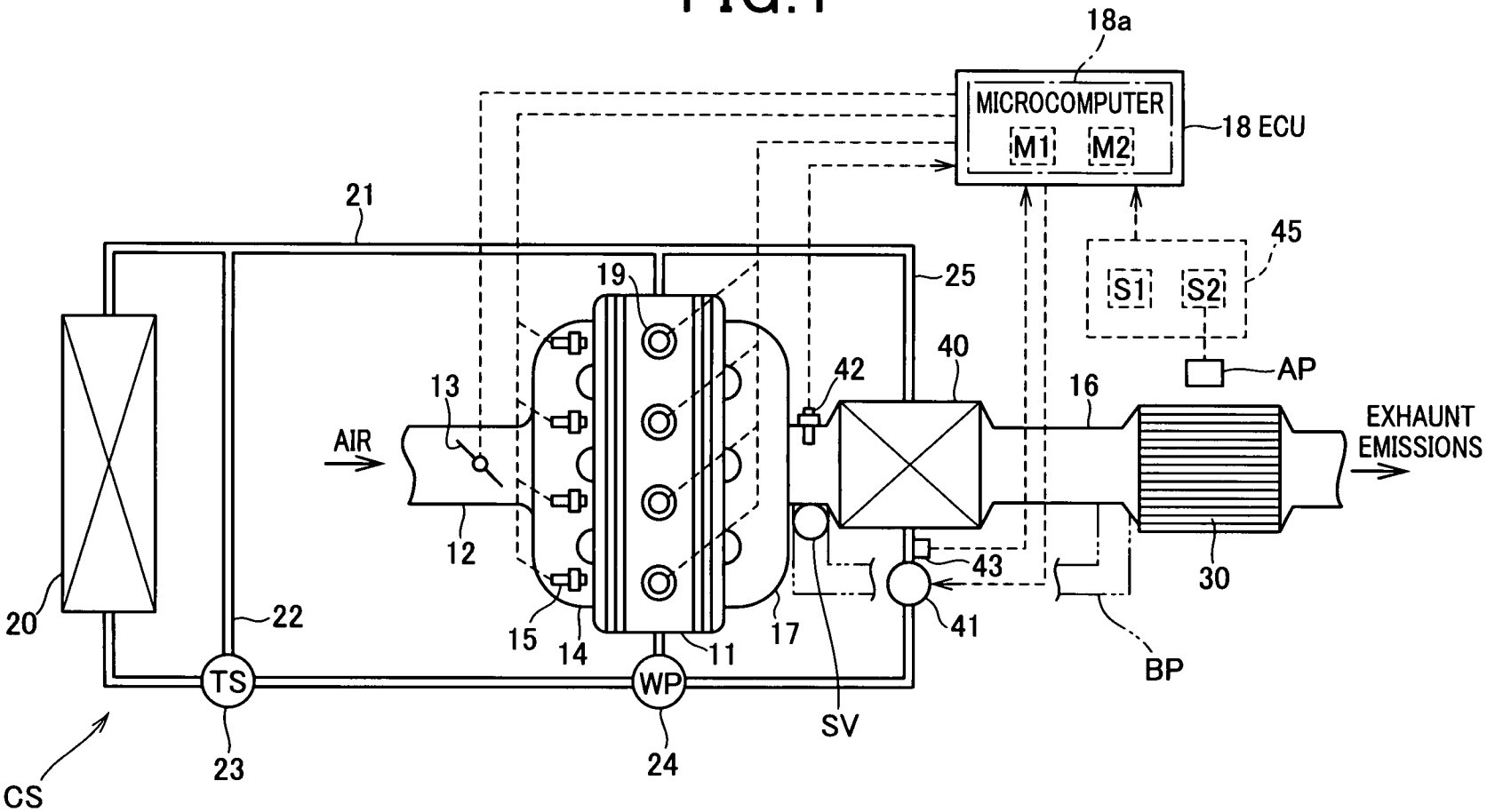
FIG. 1 is a structural view schematically illustrating an engine control system incorporating an emission control system according to the first embodiment of the present invention.

Embodiments of the present invention will be described hereinafter with reference to the accompanying drawings. In the drawings, identical reference characters are utilized to identify identical corresponding components.

First Embodiment

Referring to FIGS. 1 to 4, there is illustrated an emission control system according to the first embodiment of the present invention; this emission control system is applied to a system for controlling a spark-ignited gasoline engine (internal combustion engine) 11 installed in a motor vehicle. First, the schematic structure of the engine control system will be described hereinafter.

In the engine control system, a throttle valve 13 is installed in an intake pipe 12 of the internal combustion engine (engine) 11 to be rotatable by an actuator (not shown) under control of an electronic control unit (ECU) described later. The rotation of the throttle valve 13 allows adjustment of an opening area of the intake pipe 12 to thereby adjust the amount of air entering cylinders of the engine 11 via an intake manifold 14 as the assembly of tubes. In each of the tubes of the intake manifold 14 for a corresponding one of the cylinders, a fuel injector 15 is provided. Each of the fuel injectors 15 is operative to spray fuel into a corresponding one of the cylinders via a corresponding one of the tubes. A spark plug 19 for each cylinder is inserted in the compression chamber of each cylinder.

The cylinders of the engine 11 communicate with an exhaust pipe 16 via an exhaust manifold 17 as the assembly of tubes. An emission control device 30 is installed in the exhaust pipe 16. The emission control device 30 is operative to reduce harmful by-products in exhaust emissions exiting from the cylinders.

Figure 2A:
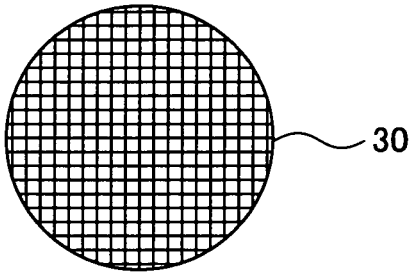
FIG. 2A is a cross sectional view of an emission control device illustrated in FIG. 1 as viewed from the downstream side thereof.
Figure 2B:
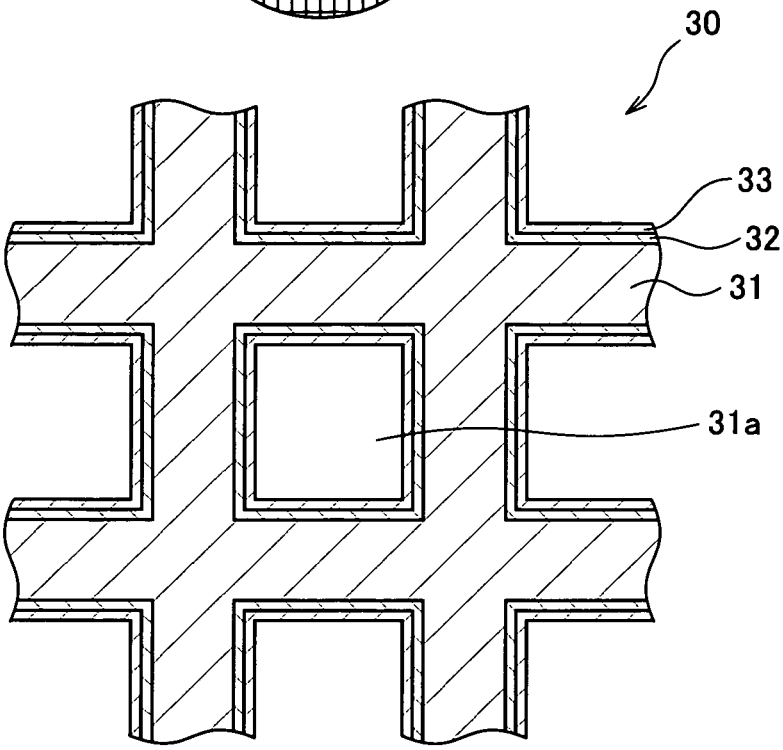
FIG. 2B is an enlarged view of part of the emission control device of FIG. 2A.

FIG. 2A is a cross sectional view of the emission control device 30 as viewed from the downstream side thereof, and FIG. 2B is an enlarged view of part of the emission control device 30 of FIG. 2A.

Referring to FIGS. 2A and 2B, the emission control device 30 is comprised of a three-way catalyst for purifying hydrocarbons (HC), carbon monoxide (CO), and oxides of nitrogen (NOx) as the harmful by-products or an oxidation catalyst for purifying the HC and CO; the three-way catalyst or the oxidation catalyst will be referred to collectively as a catalyst 33. The emission control device 30 is also comprised of an absorbent 32 for absorbing the HC. As the absorbent 32, a zeolite absorbent 32 is used in the first embodiment.

Specifically, the emission control device 30 is comprised of a ceramic honeycomb substrate, such as a cordierite honeycomb substrate, 31 having many channels (flow-through cells) 31*a*; these channels 31*a* are arranged in the flow direction of the exhaust emissions. That is, the ceramic honeycomb substrate 31 is configured as a honeycomb wall defining the channels 31*a*. On the inner surface of the honeycomb wall 31, which faces a corresponding channel 31*a*, the absorbent 32 is coated. On the inner surface of the coated absorbent 32, the catalyst 33 is carried by, for example, coating. The catalyst 33 is finely porous and contains ultrafine pores. The emission control device 30 allows the HC in the exhaust emissions flowing through the channels 31*a* to pass through their pores so as to be absorbed by the absorbent 32.

The amount of the catalyst 33 to be carried on the honeycomb substrate 31 at the downstream of the channels 31*a* is greater than that at the upstream of the channels 31*a*. For example, the amount of the catalyst 33 to be supported on the honeycomb substrate 31 is gradually increased from the upstream end of the channels 31*a* to the downstream end thereof. As another example, the amount of the catalyst 33 to be supported on the downstream half of the honeycomb substrate 31 is greater than that on the upstream half thereof. This increases the amount of the HC reacting to the catalyst 33 at the downstream of the channels 31*a* much more than that of the HC reacting to the catalyst 33 at the upstream thereof.

The zeolite forming the absorbent 32 is a crystalline, porous aluminosilicate. With increase in the silica-alumina ratio, the zeolite is improved in heat-resistance but reduced in HC absorption rate.

For this reason, the part of the zeolite absorbent 32 to be carried on the honeycomb substrate 31 at the upstream of the channels 31*a* is increased in its silica-alumina ratio to ensure sufficient heat-resistance thereof. In addition, the remaining part of the zeolite absorbent 32 to be carried on the honeycomb substrate 31 at the downstream of the channels 31*a*, which is lower in temperature than that at the upstream thereof, is reduced in its silica-alumina ratio to improve the HC absorption rate thereof. For example, the zeolite absorbent 32 to be carried on the honeycomb substrate 31 is gradually increased in its silica-alumina ratio from the downstream end of the channels 31*a* to the upstream end thereof. As another example, the zeolite absorbent 32 to be carried on the upstream half of the honeycomb substrate 31 is greater than that on the downstream half thereof.

The absorbent 32 works to absorb the HC in the exhaust emissions with its temperature within a low temperature range lower than a desorbing temperature T1 of, for example, 150° C. or thereabout, and desorb the absorbed HC with its temperature equal to or higher than the desorbing temperature T1.

The catalyst 33 is characterized to activate with its temperature equal to or higher than an activation temperature T2 of, for example, 250° C. or thereabout. In the activated state, the catalyst 33 enables the HC, CO, and NOx to be oxidized or reduced. Note that the activation temperature T2 is higher than the desorbing temperature T1.

At cold start of the engine 11 with the exhaust emissions at low temperatures, the catalyst 33 is inactivated because the temperature Tc of the catalyst 33 is lower than the activation temperature T2, so that the HC in the exhaust emissions from the engine 11 cannot be purified. During the catalyst 33 being inactivated, the HC in the exhaust emissions entering the emission control device 30 passes through the pores of the catalyst 33 to be absorbed in the absorbent 32. Thereafter, when the temperature Ta of the absorbent 32 and the temperature Tc of the catalyst 33 are increased up to the desorbing temperature T1 and the activation temperature T2, respectively, with increase in the temperature of the emission control device 30, the HC absorbed in the absorbent 32 is desorbed therefrom, and the desorbed HC is oxidized by the catalyst 33 to thereby be purified.

Note that the catalyst 33 is so supported on the absorbent 32 as to be exposed to the exhaust emissions flowing through the channels 31*a*. This causes the catalyst temperature Tc to be always higher than the absorbent temperature Ta. This temperature characteristic allows, although the activation temperature T2 is higher than the desorbing temperature T1, the timing at which the desorption of the HC is started with the absorbent temperature Ta reaching the desorbing temperature T1 to be later than or substantially equal to the timing at which the catalyst 33 allows HC purification with the catalyst temperature Tc reaching the activation temperature T2. Thus, the arrangement of the catalyst 33 on the absorbent 32 prevents the HC desorbed from the absorbent 32 from being discharged with the HC being unpurified by the catalyst 33.

The engine control system includes an ECU 18 serving as an engine control circuit. The ECU 18 is designed as, for example, a normal microcomputer 18*a* consisting of, for example, a CPU, a storage medium including a ROM (Read Only Memory), such as a rewritable ROM, a RAM (Random Access Memory), and the like, an IO (Input and output) interface, and so on.

The storage medium stores therein beforehand various engine control programs.

The ECU 18 is operative to:

control, based on the operating conditions of the engine 11, various actuators installed in the engine 11 to thereby adjust various controlled variables of the engine 11.

For example, the engine control programs include a fuel-injection control program and an ignition control program.

In the fuel-injection control program, the ECU 18 is operative to:

adjust a quantity of intake air into each cylinder according to the operating conditions of the engine 11;

compute a proper fuel injection timing and a proper injection quantity for the fuel injector 15 for each cylinder according to the operating conditions of the engine 11; and instruct the fuel injector 15 for each cylinder to spray, at a corresponding computed proper injection timing, a corresponding computed proper quantity of fuel into each cylinder.

Specifically, in the storage medium of the microcomputer 18*a*, the correlation between a variable of the engine speed, a variable of the engine load, and a variable of the proper quantity of fuel, which has been obtained by, for example, tests, is stored beforehand as a map M1. Based on the map M1, the ECU 18 references the map M1 using a present value of the engine speed and a present value of the engine load as keys to retrieve a proper quantity of fuel (target injection quantity of fuel) corresponding to the present value of the engine speed and the present value of the engine load from the map M1.

In the ignition control program, the ECU 18 is operative to:

compute a proper ignition timing for the spark plug 19 for each cylinder according to the operating conditions of the engine 11; and cause an igniter (not shown) to provide high-tension voltage to the spark plug 19 for each cylinder at the computed proper ignition timing to create a spark at the gap of the spark plug 19 for each cylinder, thus burning the mixture of the intake air and the fuel sprayed from the fuel injector 15 in the compression chamber of each cylinder.

Specifically, in the storage medium of the microcomputer 18*a*, the correlation between a variable of the engine speed, a variable of the engine load, and a variable of the proper ignition timing, which has been obtained by, for example, tests, is stored beforehand as a map M2. Based on the map M2, the ECU 18 references the map M2 using a present value of the engine speed and a present value of the engine load as keys to retrieve a proper ignition timing (target ignition timing) corresponding to the present value of the engine speed and the present value of the engine load from the map M2.

At cold start of the engine 11, the ECU 18 is programmed to carry out catalyst warm-up control including: correction of the target injection quantity of fuel for each cylinder computed based on the map M1 by increasing it, and/or retardation of the target ignition timing of each spark plug 19. The retardation of the target ignition timing of each spark plug 19 will be referred to as "ignition retarding control" hereinafter. This catalyst warm-up control aims to facilitate the increase in the temperature of the exhaust emissions, thus accelerating early activation of the catalyst 33.

The engine 11 illustrated in FIG. 1 is cooled by an engine cooling system CS. The engine cooling system CS includes a radiator (heater core) 20, a circulation pipe 21, a bypass pipe 22, a thermostat 23, a water pump 24, a heat recovery pipe 25, a heat exchanger (heat recovery device) 40, a quantity regulating valve 41, and an exhaust-emission temperature sensor 42.

The circulation pipe 21 allows an engine coolant (coolant) as a heat-transfer medium to circulate between the radiator 20 and the water jackets (channels) in the engine 11. The circulation between the radiator 20 and the water jackets of the engine 11 through the circulation pipe 21 allows the coolant that removes heat from the engine 11 to be cooled by heat exchange with ambient air.

The bypass pipe 22 is so connected to the circulation pipe 21 as to allow the coolant to circulate therethrough while bypassing the radiator 20. The thermostat 23 is mounted on a connection point between the circulation pipe 21 and the bypass pipe 22. The thermostat 23 is operative to measure the temperature of the coolant therethrough, allow circulation of the coolant through the bypass pipe 22 while bypassing the radiator 20 when the measured temperature is equal to or higher than a preset threshold, and shut off the bypass pipe 22 to allow circulation of the coolant through the radiator 20 when the measured temperature is lower than the preset threshold.

The water pump 24 is mounted on the circulation pipe 21 between the engine 11 and the thermostat 23. The water pump 24 is driven by rotation of the engine 11 to circulate the coolant through the cooling system CS by pumping it from the engine water jackets to the radiator 20. Thus, an increase in the engine rotation speed increases the driving speed of the water pump 24 to thereby increase the circulation flow rate of the coolant. The increase in the circulation flow rate of the coolant increases the amount of heat exchange between the coolant and ambient air by the radiator 20, in other words, increases the amount of the coolant to be cooled by the radiator 20. Note that the coolant is used as the heat source of an air conditioner (not shown) in the motor vehicle for air-conditioning the cabin of the motor vehicle. Specifically, the air-conditioner is operative to heat air by heat exchange with the coolant, and blow out the heated air into the cabin.

The heat exchanger 40 is provided in the exhaust pipe 16 downstream of the exhaust manifold 17 and upstream of the emission control device 30. The heat recovery pipe 25 allows the coolant as a heat-transfer medium to circulate between the heat exchanger 40 and the water jackets of the engine 11. The circulation between the heat exchanger 40 and the water jackets of the engine 11 through the heat recovery pipe 25 allows the coolant flowing through the heat exchanger 40 to remove heat of the exhaust emissions. The heat recovery pipe 25 is connected to the engine 11 commonly to the circulation pipe 21. That is, one junction between one end of the circulation pipe 21 and one end of the heat recovery pipe 25 is connected via a common pipe to one end of each of the water jackets, and the other junction between the other end of the circulation pipe 21 and the other end of the heat recovery pipe 25 is connected via a common pipe to the other end of each of the water jackets. That is, the water pump 24 is mounted on the one junction or the other junction between the engine 11 and the radiator 20, and between the engine 11 and the heat exchanger 40.

The water pump 24 is driven by rotation of the engine 11 to circulate the coolant through the heat recovery pipe 25 between the engine 11 and the heat exchanger 40. The quantity regulating valve 41 is so mounted on the heat recovery pipe 25 as to adjust the quantity of flow of the coolant therethrough. Specifically, the quantity regulating valve 41 is designed as a solenoid valve electrically connected to the ECU 18 so that the opening of the quantity regulating valve 41 is adjustable by the ECU 18. Adjustment of the opening of the quantity regulating valve 41 allows the quantity of flow of the coolant through the heat exchanger 40 to be regulated.

Thus, adjustment of the opening of the quantity regulating valve 41 to full closed position allows the quantity of flow of the coolant through the heat exchanger 40 to be regulated to zero. This allows the full quantity of flow of the coolant to circulate through the circulation pipe 21 by the water pump 24. On the other hand, the adjustment of the opening of the quantity regulating valve 41 to a given open position allows a given quantity of flow of the coolant to be circulated by the water pump 24 through the heat exchanger 40 so that the given quantity of flow of the coolant removes heat from the exhaust emissions by heat exchange therewith. Thus, at cold start of the engine 11, adjustment of the opening of the quantity regulating valve 41 to a given open position removes heat from the exhaust emissions, thus facilitating warm-up of the engine 11 and heating the air blown out from the air conditioner early after the start up of the engine 11.

The exhaust-emission temperature sensor 42 is provided in the exhaust pipe 16 at the upstream of the heat exchanger 40. The exhaust-emission temperature sensor 42 is operative to measure the temperature of the exhaust emissions. The temperature of the exhaust emissions measured by the temperature sensor 42 is the temperature of the exhaust emissions entering the heat exchanger 40 before heat exchange; this temperature of the exhaust emissions will be referred to as "heat-exchanger inlet temperature Tex" hereinafter. The exhaust-emission temperature sensor 42 is electrically connected to the ECU 18 so that the heat-exchanger inlet temperature Tex measured by the sensor 42 is sent to the ECU 18. The ECU 18 is operative to adjust, based on the heat-exchanger inlet gas temperature Tex, the opening of the quantity regulating valve 41 to thereby regulate the quantity of flow of the coolant to be circulated into the heat exchanger 40, thus adjusting the recovery of exhaust heat (an amount of heat recovered by the heat exchanger 40) from the exhaust emissions.

The emission control system according to this embodiment is comprised of, for example, at least the engine control system including the ECU 18, the emission control device 30, the heat exchanger 40, the quantity regulating valve 41, and the exhaust-emission temperature sensor 42.

If the catalyst warm-up control were executed immediately after cold start-up of the engine 11, the absorbent temperature Ta would be equal to or higher than the desorbing temperature T1 with the amount of the absorbed HC being not up to a given saturated amount thereof. This could not make full use of the absorption capabilities of the absorbent 32.

In order to address this problem, the emission control system according to this embodiment is designed to blunt the rise of the absorbent temperature Ta to delay the arrival of the absorbent temperature Ta to the desorbing temperature T1 until the heat-exchanger inlet temperature Tex reaches the activation temperature T2 by maximizing the quantity of flow of the coolant to be circulated through the heat exchanger 40 to carry out exhaust heat recovery at the full capacity of the engine cooling system CS.

On the other hand, after the arrival of the heat-exchanger inlet temperature Tex to the activation temperature T2, the emission control system is designed to facilitate the rise in the catalyst temperature Tc to accelerate the arrival of the catalyst temperature Tc to the activation temperature T2 by minimizing the quantity of flow of the coolant to be circulated through the heat exchanger 40 to zero to minimize the recovery of exhaust heat from the exhaust emissions.

This design of the emission control system aims to early complete the catalyst warm-up control while sufficiently increasing the amount of the HC to be absorbed in the absorbent 32.

Figure 3:
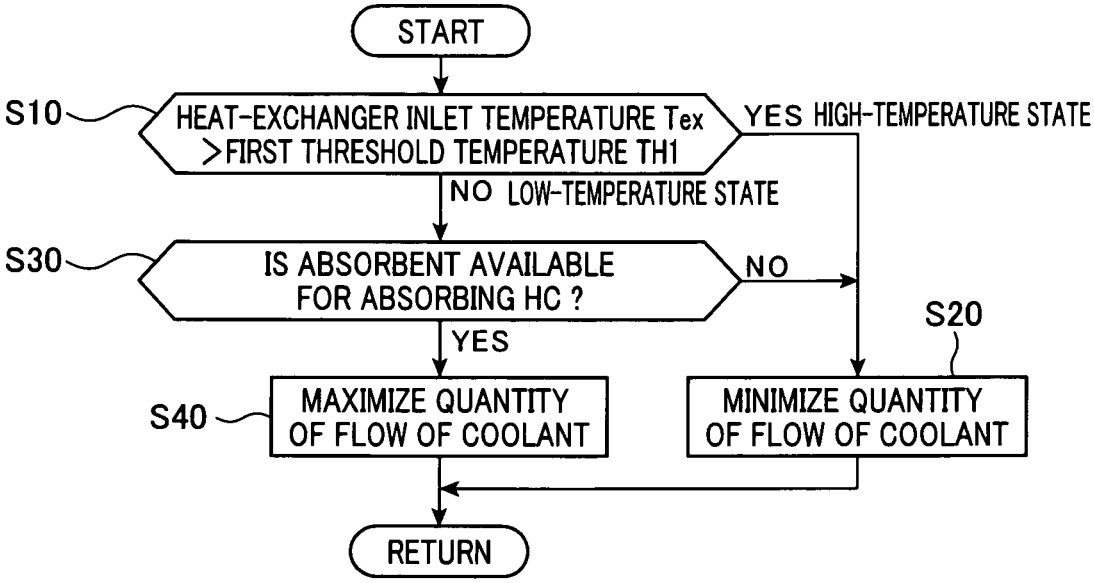
FIG. 3 is a flowchart schematically illustrating operations of a microcomputer of an ECU illustrated in FIG. 1 to carry out a quantity reducing task (first task) in accordance with a quantity reducing program (first program) according to the first embodiment.

Next, a quantity reducing task (first task) to be executed by the ECU 18 for changing the quantity of flow of the coolant to be circulated into the heat exchanger 40 from its upper limit to zero with increase in the heat-exchanger inlet temperature Tex to reduce the quantity of flow of the coolant to be circulated into the heat exchanger 40 in accordance with a quantity reducing program (first program) stored in the storage medium will be described hereinafter with reference to FIG. 3. FIG. 3 is a flowchart schematically illustrating operations of the microcomputer 18*a* of the ECU 18 to carry out the quantity reducing task in accordance with the quantity reducing program. The microcomputer 18*a* repeatedly runs the quantity reducing program in a preset cycle after it is activated in response to the turning on of an ignition switch of the motor vehicle as a trigger; this preset cycle corresponds to the clock cycle of the CPU or a preset crank angle.

When launching the quantity reducing program, the microcomputer 18*a* determines whether the heat-exchanger inlet temperature Tex obtained from the exhaust-emission temperature sensor 42 is equal to or higher than the activation temperature T2 or lower than the activation temperature T2 in step S10. Specifically, in the storage medium or the quantity reducing program, a first threshold temperature TH1 that is slightly higher than the activation temperature T2 has been set. In step S10, the microcomputer 18*a* determines whether the heat-exchanger inlet temperature Tex is higher than the first threshold temperature TH1. Upon determining that the heat-exchanger inlet temperature Tex is higher than the first threshold temperature TH1, the microcomputer 18*a* determines that the heat-exchanger inlet temperature Tex is in high-temperature state equal to or higher than the activation temperature T2, and otherwise, the microcomputer 18*a* determines that the heat-exchanger inlet temperature Tex is in low-temperature state lower than the activation temperature T2.

Setting the first threshold temperature TH1 to be slightly higher than the activation temperature T2 allows the microcomputer 18*a* to determine that the heat-exchanger inlet temperature Tex is in the high-temperature state under the heat-exchanger inlet temperature Tex being reliably higher than the activation temperature T2. If the first threshold temperature TH1 were set to be significantly higher than the activation temperature T2, the possibility that the heat-exchanger inlet temperature Tex is equal to or higher than the activation temperature T2 when the heat-exchanger inlet temperature Tex is in the high-temperature state could be enhanced. However, because the rise in the catalyst temperature Tc could be facilitated with a heat-exchanger outlet temperature Tout described later being excessively high, the catalyst temperature Tc would exceed an upper temperature limit of the catalyst 33. Thus, in this embodiment, the first threshold temperature TH1 is set to be sufficiently lower than the upper temperature limit of the catalyst 33.

Upon determining that the heat-exchanger inlet temperature Tex is in the high-temperature state (YES in step S10), that is, the heat-exchanger inlet temperature Tex is higher than the first threshold temperature TH1 (Tex>TH1), the microcomputer 18*a* proceeds to step S20. In step S20, the microcomputer 18*a* instructs the quantity regulating valve 41 to adjust its opening to thereby minimize the quantity of flow of the coolant to be circulated to the heat exchanger 40 to zero. This operation minimizes the recovery of exhaust heat by the heat exchanger 40 so that the temperature of the exhaust emissions entering the emission control device 30 is increased; this temperature will be referred to as "heat-exchanger outlet temperature Tout" hereinafter. This results in early activation of the catalyst 33.

Otherwise, upon determining that the heat-exchanger inlet temperature Tex is in the low-temperature state (NO in step S10), that is, the heat-exchanger inlet temperature Tex is equal to or lower than the first threshold temperature TH1 (Tex≤TH1), the microcomputer 18*a* proceeds to step S30. In step S30, the microcomputer 18*a* determines whether the absorbent 32 is available for absorbing the HC.

Specifically, when the following two conditions are met, the microcomputer 18*a* determines that the absorbent 32 is available for absorbing the HC:

The first condition is that the absorbent temperature Ta does not reach the desorbing temperature T1

The second condition is that the amount of the HC absorbed in the absorbent 32 does not reach the saturated amount That is, when the absorbent temperature Ta reaches the desorbing temperature T1 without the amount of the HC absorbed in the absorbent 32 reaching the saturated amount, the microcomputer 18*a* determines that the absorbent 32 is not available for absorbing the HC. In addition, when the absorbent temperature Ta does not reach the desorbing temperature T1 with the amount of the HC absorbed in the absorbent 32 having reached the saturated amount, the microcomputer 18*a* determines that the absorbent 32 is not available for absorbing the HC.

For example, the microcomputer 18*a* can be programmed to calculate the absorbent temperature Ta based on the temperature measured by the exhaust-emission temperature sensor 42 and the present quantity of flow of the coolant to be circulated to the heat exchanger 40, and to determine whether the absorbent temperature Ta reaches the desorbing temperature T1 based on the calculated absorbent temperature Ta. The quantity of flow of the coolant to be circulated to the heat exchanger 40 can be grasped by the present opening of the flowing regulating valve 41 under control of the ECU 18. A sensor S1 can be provided for measuring the absorbent temperature Ta, and the microcomputer 18*a* can determine whether the absorbent temperature Ta reaches the desorbing temperature T1 based on a measured value of the absorbent temperature Ta by the sensor S1.

The microcomputer 18*a* can determine whether the amount of the HC absorbed in the absorbent 32 reaches the saturated amount by determination of whether an elapsed time after the start-up of the engine 11 reaches a preset time in step S30. The microcomputer 18*a* can determine whether the amount of the HC absorbed in the absorbent 32 reaches the saturated amount based on the history of a manipulated variable indicative of the position or stroke of a driver-operable accelerator pedal AP of the motor vehicle during warming up of the engine 11 immediately after the start-up of the engine 11 in step S30; this accelerator pedal AP is linked to a throttle valve for controlling the amount of air entering the intake manifold 14.

The history of the manipulated variable indicative of an actual position or stroke of a driver-operable accelerator pedal AP of the motor vehicle can be measured by a sensor S2 provided in the motor vehicle. For example, the microcomputer 18*a* can determine that the amount of the HC absorbed in the absorbent 32 reaches the saturated amount when an integrated value of the manipulated variable indicative of the position or stroke of the accelerator pedal AP exceeds a preset threshold value in step S30.

The microcomputer 18*a* can also determine whether the amount of the HC absorbed in the absorbent 32 reaches the saturated amount when an integrated value of the amount of heat supplied to the absorbent 32 reaches a preset value in step S30. For example, the microcomputer 18*a* can calculate a present amount of heat supplied to the absorbent 32 based on parameters of the operating conditions of the engine 11; these parameters include a present instructed quantity of fuel for each fuel injector, an present air-intake quantity, a present position or stroke of the accelerator pedal AP, which are associated with the engine load, a present engine speed, and a present quantity of flow of the coolant circulated to the heat exchanger 40 in step S30.

The microcomputer 18*a* can also determine whether the amount of the HC absorbed in the absorbent 32 reaches the saturated amount when the engine speed reaches a preset value in step S30.

Note that sensors 45 including the sensors S1 and S2 are installed in the motor vehicle for measuring the operating conditions of the engine 11. The air-intake quantity and the engine speed are measured by corresponding sensors 45 and sent to the ECU 18 so that the ECU 18 grasps the operating conditions of the engine 11.

Upon determining that the absorbent 32 is available for absorbing the HC (YES in step S30) after it is determined that the heat-exchanger inlet temperature Tex is in the low-temperature state (the negative determination in step S10), the microcomputer 18*a* proceeds to step S40. In step S40, the microcomputer 18*a* instructs the quantity regulating valve 41 to adjust its opening in fully open condition to thereby maximize the quantity of flow of the coolant to be circulated to the heat exchanger 40. This operation maximizes the recovery of exhaust heat by the heat exchanger 40 so that the rise in the heat-exchanger outlet temperature Tout is blunted. The blunting of the rise in the heat-exchanger outlet temperature Tout increases the time taken for the absorbent temperature Ta to reach the desorbing temperature T1 with the absorbent 32 being available for absorbing the HC, resulting in an increased amount of the HC to be absorbed in the absorbent 32.

Otherwise, upon determining that the absorbent 32 is not available for absorbing the HC (NO in step S30) after it is determined that the heat-exchanger inlet temperature Tex is in the low-temperature state (the negative determination in step S10), the microcomputer 18*a* proceeds to step S20 set forth above, and minimizes the quantity of flow of the coolant to be circulated to the heat exchanger 40 to zero. The operation facilitates the rise in the heat-exchanger outlet temperature Tout in priority to absorption of the HC, thus accelerate early activation of the catalyst 33.

Next, an example of the operations illustrated in FIG. 3 will be described hereinafter with reference to a timing chart of FIG. 4. (a) of FIG. 4 illustrates the change in the quantity of flow of the coolant to be circulated to the heat exchanger 40 with time, and the dashed line in (b) of FIG. 4 illustrates the change in the heat-exchanger inlet temperature Tex with time, the solid line in (b) of FIG. 4 illustrates the change in the heat-exchanger outlet temperature Tout with time, and the dash dot line in (b) of FIG. 4 illustrates the change in the catalyst temperature Tc with time.

Figure 4:
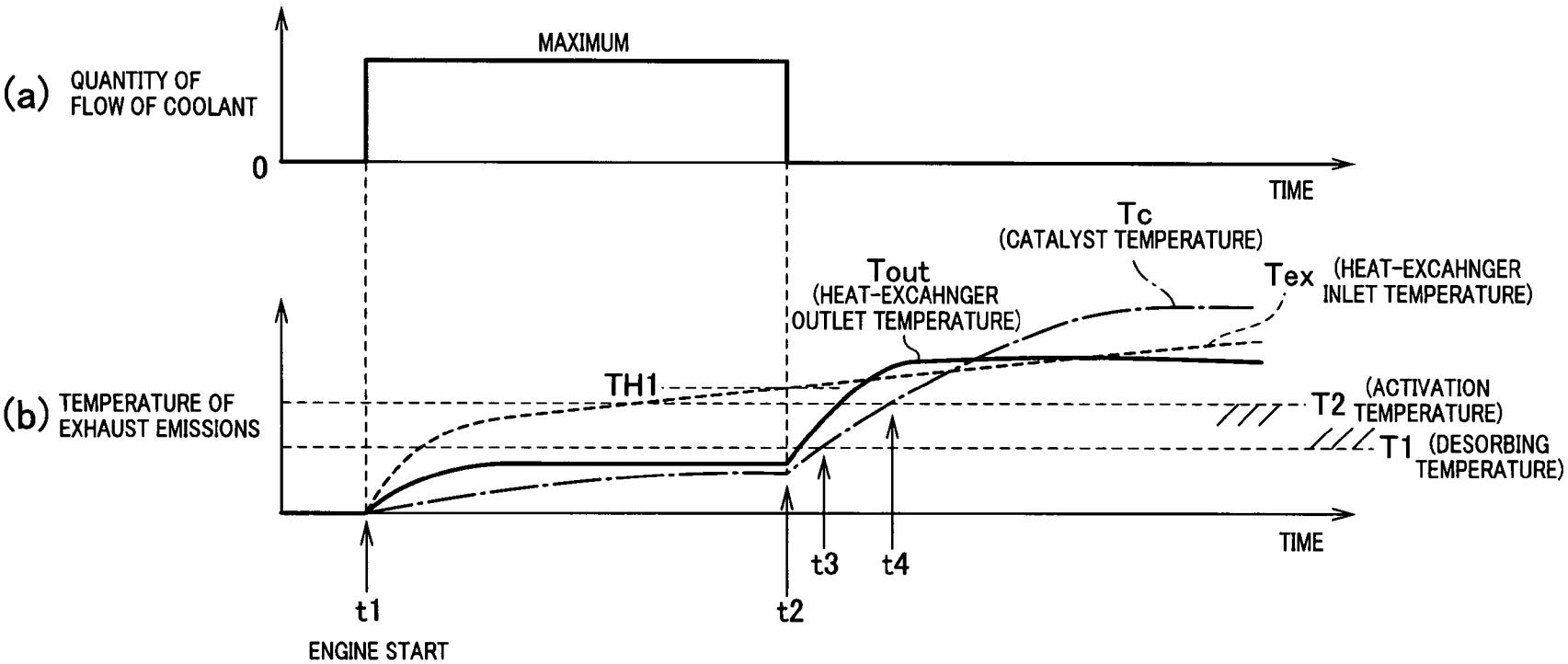
FIG. 4 is a timing chart schematically illustrating an example of the operations illustrated in FIG. 3 according to the first embodiment.

Referring to FIG. 4, when the engine 11 is started at time t1, because the absorbent 32 is available for absorbing the HC and the heat-exchanger inlet temperature Tex is in the low-temperature state, the quantity of flow of the coolant to be circulated to the heat exchanger 40 is adjusted to be maximized in step S40. Thereafter, the heat-exchanger inlet temperature Tex is gradually increased with gradual increase in the engine temperature. However, the rise in the heat-exchanger outlet temperature Tout is blunted so that the rise in the catalyst temperature Tc is blunted because the quantity of flow of the coolant to be circulated to the heat exchanger 40 is maximized so that the recovery of heat from the exhaust emissions is maximized. Note that the absorbent temperature Ta follows the catalyst temperature Tc so that the rise in the absorbent temperature Ta is also blunted.

Thereafter, when the heat-exchanger inlet temperature Tex reaches, at time t2, the first threshold temperature TH1 higher than the activation temperature T2 without the absorbent 32 being saturated and the absorbent temperature Ta reaching the desorbing temperature T1, it is determined that the heat-exchanger inlet temperature Tex is in the high-temperature state so that the quantity of flow of the coolant to be circulated to the heat exchanger 40 is adjusted to be minimized to zero in step S20. This adjustment minimizes the recovery of heat from the exhaust emissions by the heat exchanger 40, thus facilitating the rise in the heat-exchanger outlet temperature Tout, and therefore, facilitating the rise in the catalyst temperature Tc.

Thereafter, when the catalyst temperature Tc reaches the activation temperature T2 at time t4, the oxidation reaction of the catalyst 33 is started so that the catalyst temperature Tc is increased to be higher than the heat-exchanger inlet temperature Tex by the heat of the oxidation reaction.

Note that, in this embodiment, the catalyst warm-up control is carried out at time t2 when the heat-exchanger inlet temperature Tex reaches the first threshold temperature TH1, but it can be carried out at time t1 when the engine 11 is started, or it cannot be carried out.

As described above, the emission control system according to this embodiment is provided with the heat exchanger 40 located upstream of the emission control device 30, and configured to regulate the quantity of flow of the coolant to be circulated to the heat exchanger 40 to thereby adjust the recovery of heat from the exhaust emissions. This adjustment of the recovery of heat allows adjustment of the temperature (heat-exchanger outlet temperature Tout) of the exhaust emissions entering the emission control device 30.

In addition, the emission control system is configured to maximize the quantity of flow of the coolant to be circulated to the heat exchanger 40 with the heat-exchanger inlet temperature Tex being in the low-temperature state lower than the activation temperature T2. This configuration blunts the rise in the temperature Tout of the exhaust emissions at the outlet of the heat exchanger 40 entering the emission control device 30. Thus, it is possible to lengthen the time until the absorbent temperature Ta reaches the desorbing temperature T1, and therefore to increase the amount of the HC to be absorbed in the absorbent 32. This makes full use of the absorption capabilities of the absorbent 32.

The emission control system is configured to minimize the quantity of flow of the coolant to be circulated to the heat exchanger 40 to zero with the heat-exchanger inlet temperature Tex being in the high-temperature state equal to of higher than the activation temperature T2. This configuration facilitates the rise in the temperature Tout of the exhaust emissions at the outlet of the heat exchanger 40 entering the emission control device 30. Thus, it is possible to reduce the period from time t3 at which the absorbent 32 becomes unavailable for absorbing the HC to time t4 at which the catalyst temperature Tc reaches the activation temperature T2, resulting in early completion of the catalyst warm-up control.

The emission control system is configured to minimize the quantity of flow of the coolant to be circulated to the heat exchanger 40 to zero with the heat-exchanger inlet temperature Tex being in the low-temperature state and the absorbent 32 being unavailable for absorbing the HC, thus facilitating the rise in the catalyst temperature Tc. This configuration facilitates the rise in the catalyst temperature Tc immediately without waiting for the shift of the heat-exchanger inlet temperature Tex to the high-temperature state, resulting in early completion of the catalyst warm-up control. Particularly, because the emission control system carries out the quantity reduction control with the absorbent temperature being higher than the desorbing temperature T1 even if the heat-exchanger inlet temperature Tex being in the low-temperature state, it is possible to reduce the period from time t3 to time t4; this period represents dead period during which no absorption and oxidation are carried out.

The emission control system is configured to start the catalyst warm-up control when the heat-exchanger inlet temperature Tex is shifted from the low-temperature state to the high-temperature state while minimizing the quantity of flow of the coolant to be circulated to the heat exchanger 40 to zero so as to facilitate the rise in the catalyst temperature Tc. This configuration reduces the amount of control of controlled variables required for the catalyst warm-up control, such as the amount of correction of the target injection quantity of fuel for each cylinder and/or the amount of correction of the target ignition timing of each spark plug 19, or reduces the time to carry out the catalyst warm-up control. This reduces the effects of the catalyst warm-up control on fuel economy.

The emission control system is configured to maximize the quantity of flow of the coolant to be circulated to the heat exchanger 40 with the heat-exchanger inlet temperature Tex being in the low-temperature state to thereby sufficiently increase the recovery of heat from the exhaust emissions by the heat exchanger 40. This allows the air conditioner to early use the coolant as its heart source, thus reducing the period from the engine start-up timing t1 to the time at which the temperature of the cabin reaches its target temperature.

Second Embodiment

An emission control system according to the second embodiment of the present invention will be described hereinafter with reference to FIGS. 5 and 6.

The structure and/or functions of the emission control system according to the second embodiment are different from the emission control system according to the first embodiment by the following points. So, the different points will be mainly described hereinafter.

The emission control system according to the first embodiment is configured to determine whether the temperature of the exhaust emissions at the upstream of the heat exchanger 40 is in the low-temperature state or in the high-temperature state based on the heat-exchanger inlet temperature Tex measured by the exhaust-emission temperature sensor 42.

On the other hand, the emission control system according to the second embodiment is provided with a coolant temperature sensor 43 (see FIG. 1) for measuring the temperature Tw of the coolant as a heat-transfer medium of the heat exchanger 40. Thus, the coolant temperature sensor 43 cannot be required for the emission control system according to the first embodiment. The emission control system according to the second embodiment is configured to determine whether the temperature of the exhaust emissions at the upstream of the heat exchanger 40 is in the low-temperature state or in the high-temperature state based on the coolant temperature Tw measured by the coolant temperature sensor 43.

Specifically, the coolant temperature sensor 43 is located close to the coolant outlet of the heat exchanger 40. This location of the coolant temperature sensor 43 allows the coolant temperature sensor 43 to measure the temperature of the coolant immediately after heat exchange to the exhaust emissions by the heat exchanger 40 with its quantity of flow having been regulated by the quantity regulating valve 41.

Figure 5:
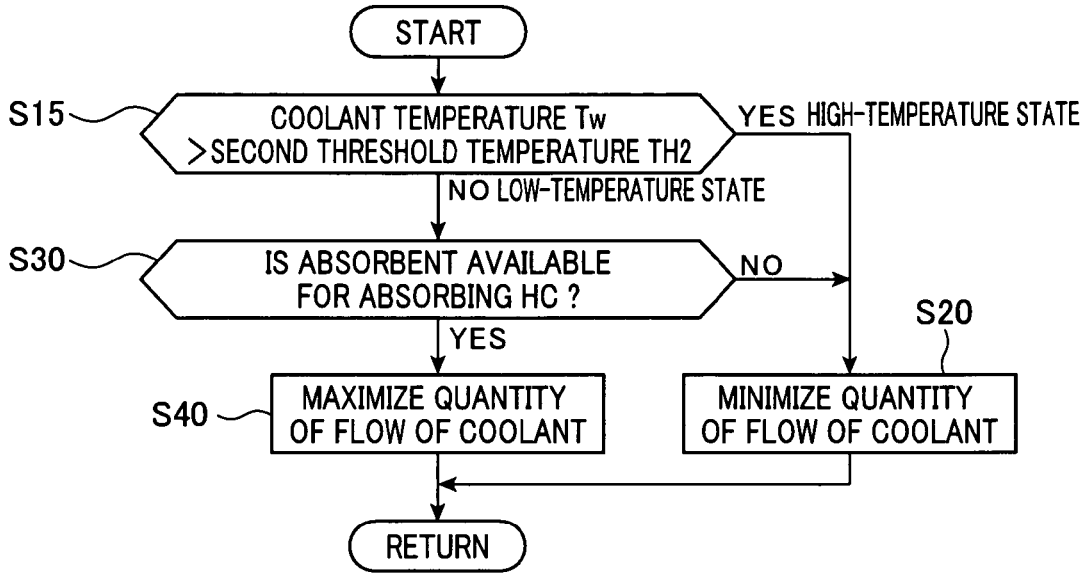
FIG. 5 is a flowchart schematically illustrating operations of the microcomputer to carry out a quantity reducing task (second task) in accordance with a quantity reducing program (second program) according to the second embodiment of the present invention.

FIG. 5 is a flowchart schematically illustrating operations of the microcomputer 18*a* of the ECU 18 to carry out a quantity reducing task (second task) in accordance with a quantity reducing program (second program) according to the second embodiment. As well as the first embodiment, the microcomputer 18*a* repeatedly runs the quantity reducing program in a preset cycle after it is activated in response to the turning on of an ignition switch of the motor vehicle as a trigger; this preset cycle corresponds to the clock cycle of the CPU or a preset crank angle.

Note that, the higher the heat-exchanger inlet temperature Tex is, the higher the coolant temperature Tw is. Particularly, this feature becomes more prominent with the quantity of flow of the coolant to be circulated to the heat exchanger 40 being not zero.

Thus, when launching the quantity reducing program, the microcomputer 18*a* determines whether the coolant temperature Tw is higher than a previously set second threshold temperature TH2 in steps S15. Upon determining that the coolant temperature Tw is higher than the second threshold temperature TH2, the microcomputer 18*a* determines that the heat-exchanger inlet temperature Tex is in the high-temperature state equal to or higher than the activation temperature T2, and otherwise, the microcomputer 18*a* determines that the heat-exchanger inlet temperature Tex is in the low-temperature state lower than the activation temperature T2.

For example, the correlation between the variable of the coolant temperature Tw and the heat-exchanger inlet temperature Tex has been obtained by, for example, tests. Based on the correlation, a value of the coolant temperature Tw when the heat-exchanger inlet temperature Tex reaches the first threshold temperature TH1 has been calculated, and the value of the coolant temperature Tw has been set as the second threshold temperature TH2, and the second threshold temperature TH2 has been stored in the storage medium or described in the quantity reducing program. Because the correlation varies depending on the engine speed and/or the engine load, it is possible to variably set a value of the second threshold temperature TH2 based on the present engine speed and/or present engine load. Because the operations of steps S20, S30, and S40 after the operation in step S15 are identical to those of steps S20, S30, and S40 illustrated in FIG. 3, the descriptions of them are omitted.

Next, an example of the operations illustrated in FIG. 5 will be described hereinafter with reference to a timing chart of FIG. 6. (a) of FIG. 6 illustrates the change in the quantity of flow of the coolant to be circulated to the heat exchanger 40 with time, and the dashed line in (b) of FIG. 6 illustrates the change in the heat-exchanger inlet temperature Tex with time, the solid line in (b) of FIG. 6 illustrates the change in the heat-exchanger outlet temperature Tout with time, and the dash dot line in (b) of FIG. 6 illustrates the change in the catalyst temperature Tc with time. (c) of FIG. 6 illustrates the change in the coolant temperature Tw with time.

Figure 6:
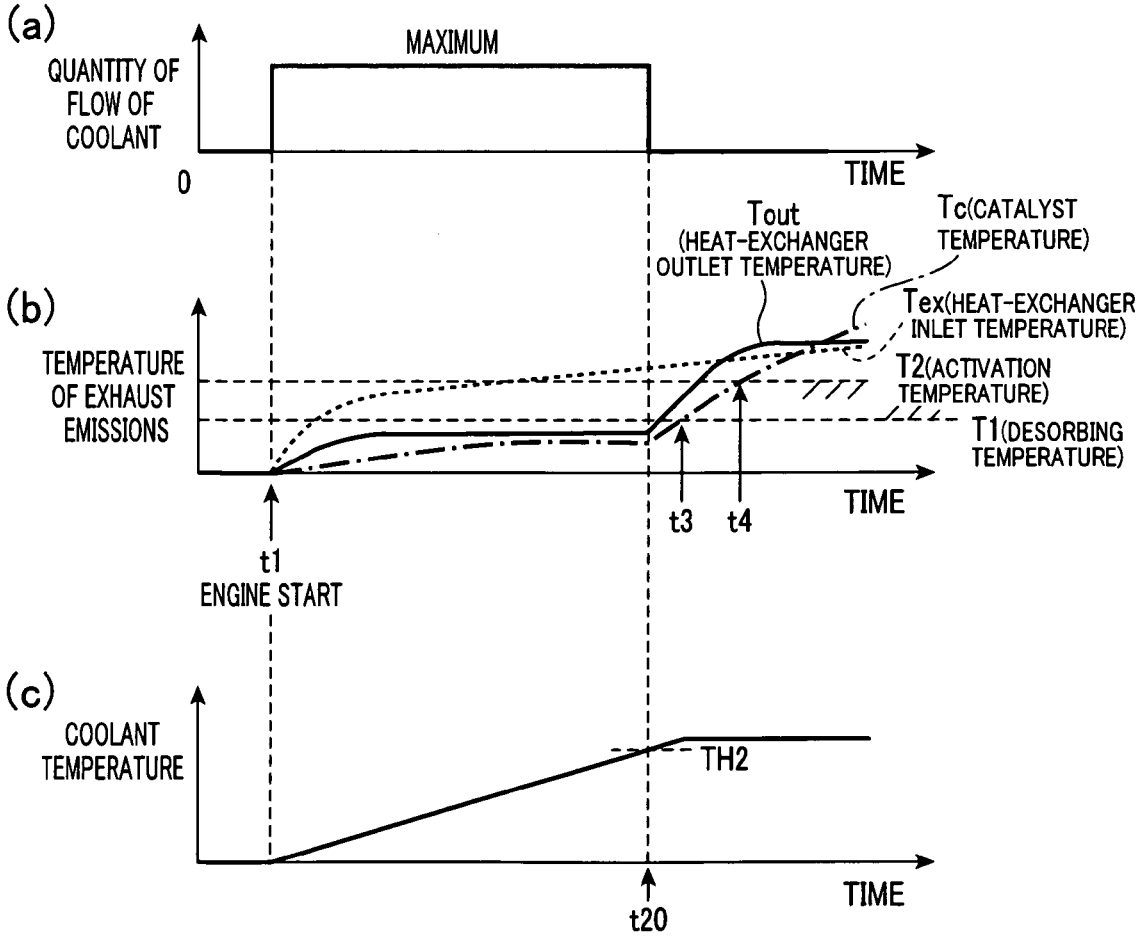
FIG. 6 is a timing chart schematically illustrating an example of the operations of the microcomputer illustrated in FIG. 5.

Referring to FIG. 6, when the engine 11 is started at time t1, because the absorbent 32 is available for absorbing the HC and the heat-exchanger inlet temperature Tex is in the low-temperature state, the quantity of flow of the coolant to be circulated to the heat exchanger 40 is adjusted to be maximized in step S40. Thereafter, the heat-exchanger inlet temperature Tex and the coolant temperature Tw are gradually increased with gradual increase in the engine temperature. However, the rise in the heat-exchanger outlet temperature Tout is blunted so that the rise in the catalyst temperature Tc is blunted because the quantity of flow of the coolant to be circulated to the heat exchanger 40 is maximized so that the recovery of heat from the exhaust emissions is maximized. Note that the absorbent temperature Ta follows the catalyst temperature Tc so that the rise in the absorbent temperature Ta is also blunted.

Thereafter, when the coolant temperature Tw reaches, at time t20, the second threshold temperature TH2 higher than the activation temperature T2 without the absorbent 32 being saturated and the absorbent temperature Ta reaching the desorbing temperature T1, it is determined that the heat-exchanger inlet temperature Tex is in the high-temperature state so that the quantity of flow of the coolant to be circulated to the heat exchanger 40 is adjusted to be minimized to zero in step S20. This adjustment minimizes the recovery of heat from the exhaust emissions by the heat exchanger 40, thus facilitating the rise in the heat-exchanger outlet temperature Tout, and therefore, facilitating the rise in the catalyst temperature Tc.

Accordingly, the emission control system according to second embodiment achieves effects that are the same as the first embodiment.

Specifically, the emission control system according to second embodiment is configured to maximize the quantity of flow of the coolant to be circulated to the heat exchanger 40 with the heat-exchanger inlet temperature Tex being in the low-temperature state lower than the activation temperature T2. This configuration blunts the rise in the temperature Tout of the exhaust emissions at the outlet of the heat exchanger 40 entering the emission control device 30. Thus, it is possible to lengthen the time until the absorbent temperature Ta reaches the desorbing temperature T1, and therefore to increase the amount of the HC to be absorbed in the absorbent 32. This makes full use of the absorption capabilities of the absorbent 32.

In addition, the emission control system according to the second embodiment is configured to minimize the quantity of flow of the coolant to be circulated to the heat exchanger 40 to zero with the heat-exchanger inlet temperature Tex being in the high-temperature state equal to of higher than the activation temperature T2. This configuration facilitates the rise in the temperature Tout of the exhaust emissions at the outlet of the heat exchanger 40 entering the emission control device 30. Thus, it is possible to reduce the period from time t3 at which the absorbent 32 becomes unavailable for absorbing the HC to time t4 at which the catalyst temperature Tc reaches the activation temperature T2, resulting in early completion of the catalyst warm-up control.

The emission control system according to the second embodiment is also configured to minimize the quantity of flow of the coolant to be circulated to the heat exchanger 40 to zero with the heat-exchanger inlet temperature Tex being in the low-temperature state and the absorbent 32 being unavailable for absorbing the HC, thus facilitating the rise in the catalyst temperature Tc. This configuration facilitates the catalyst temperature Tc immediately without waiting for the shift of the heat-exchanger inlet temperature Tex to the high-temperature state, resulting in early completion of the catalyst warm-up control. Particularly, because the emission control system carries out the quantity reduction control with the absorbent temperature being higher than the desorbing temperature T1 even if the heat-exchanger inlet temperature Tex being in the low-temperature state, it is possible to reduce the period from time t3 to time t4; this period represents dead period during which no absorption and oxidation are carried out.

The emission control system according to the second embodiment is further configured to minimize the quantity of flow of the coolant to be circulated to the heat exchanger 40 to zero with the heat-exchanger inlet temperature Tex being in the low-temperature state so as to facilitate the rise in the catalyst temperature Tc. This configuration reduces the amount of control of controlled variables required for the catalyst warm-up control, such as the amount of correction of the computed injection quantity for each cylinder and/or the amount of correction of the computed ignition timing of each spark plug 19, or reduces the time to carry out the catalyst warm-up control. This reduces the effects of the catalyst warm-up control on fuel economy.

The emission control system according to the second embodiment is configured to maximize the quantity of flow of the coolant to be circulated to the heat exchanger 40 with the heat-exchanger inlet temperature Tex being in the low-temperature state to thereby sufficiently increase the recovery of heat from the exhaust emissions by the heat exchanger 40. This allows the air conditioner to early use the coolant as its heart source, thus reducing the period from the engine start-up timing t1 to the time at which the temperature of the cabin reaches its target temperature.

Third Embodiment

Figure 7:
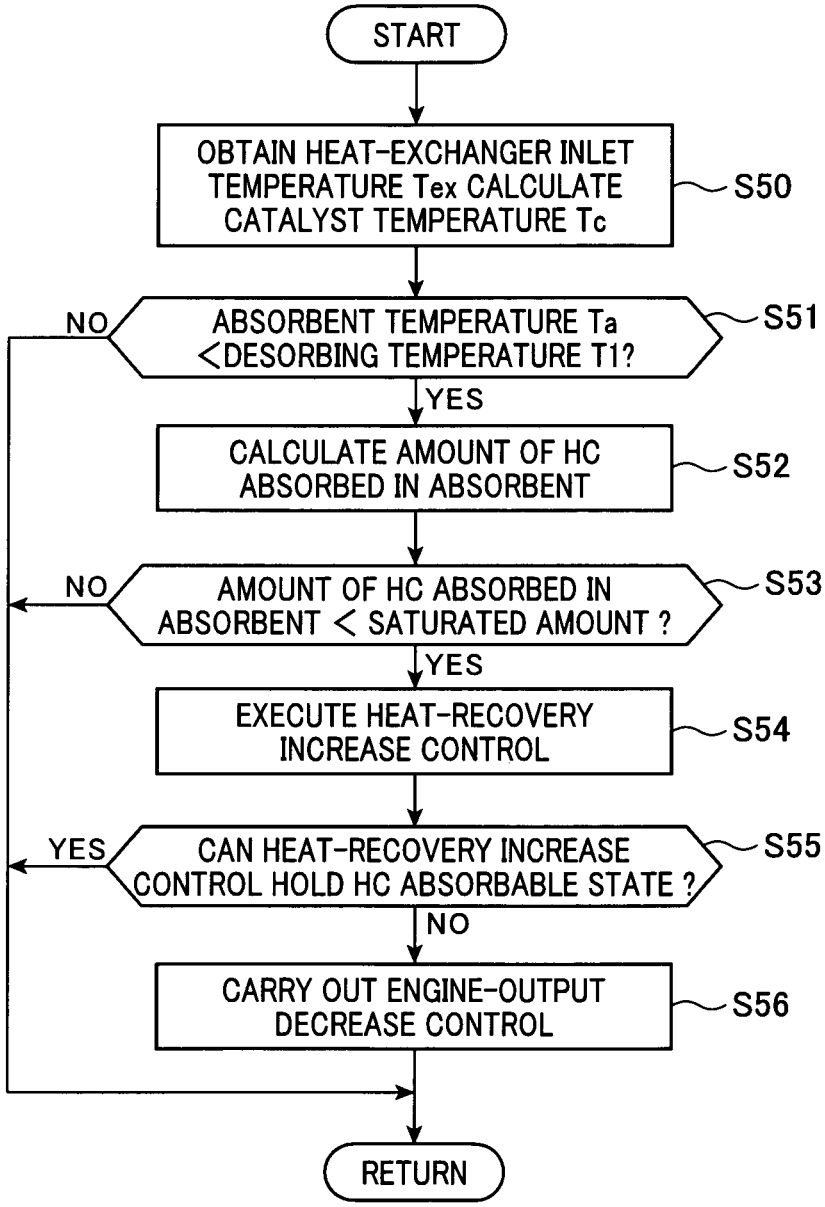
FIG. 7 is a flowchart schematically illustrating operations of the microcomputer to carry out a third task in accordance with a third task program according to the third embodiment of the present invention.

An emission control system according to the third embodiment of the present invention will be described hereinafter with reference to FIGS. 7 and 8.

The structure and/or functions of the emission control system according to the third embodiment are different from the emission control system according to the first embodiment by the following points. So, the different points will be mainly described hereinafter.

As described above, if the catalyst warm-up control were executed immediately after cold start-up of the engine, the absorbent temperature Ta would be equal to or higher than the desorbing temperature T1 with the amount of the absorbed HC being not up to a given saturated amount thereof. This could not make full use of the absorption capabilities of the absorbent 32.

In order to address this problem, the emission control system according to the third embodiment is designed to carry out the following "heat-recovery increase control" and "engine-output decrease control" until the absorbent temperature Ta reaches the desorbing temperature T1. The heat-recovery increase control is to maximize the quantity of flow of the coolant to be circulated through the heat exchanger 40 to carry out exhaust heat recovery at the full capacity of the engine cooling system CS. This reduces the temperature of the exhaust emissions entering the emission control device 30. The engine-output decrease control is to correct the normal target injection quantity of fuel for each cylinder computed based on the map M1 by reducing it, thus reducing the engine output. This reduces the temperature of the exhaust emissions entering the emission control device 30.

On the other hand, after the arrival of the absorbent temperature Ta to the desorbing temperature T1, the emission control system is designed to facilitate the rise in the catalyst temperature Tc to accelerate the arrival of the catalyst temperature Tc to the activation temperature T2 by terminating the heat-recovery increase control to minimize the quantity of flow of the coolant to be circulated through the heat exchanger 40 to zero. Additionally, after the arrival of the absorbent temperature Ta to the desorbing temperature T1, the emission control system is designed to terminate the engine-output decrease control to instruct the fuel injector 15 for each cylinder to spray, at the target injection timing, the normal target quantity of fuel or a corrected normal target quantity of fuel under the catalyst warm-up control into each cylinder. This results in early complete the catalyst warm-up control while sufficiently increasing the amount of the HC to be absorbed in the absorbent 32. Note that the absorbent temperature Ta and the catalyst temperature Tc are estimated based on the heat-exchanger inlet temperature Tex measured by the exhaust-emission temperature sensor 42 and the recovery of exhaust heat from the exhaust emissions.

Next, a third task of the heat-recovery increase control and the engine-output decrease control to be executed by the ECU 18 in accordance with a third task program stored in the storage medium will be described hereinafter with reference to FIG. 7. FIG. 7 is a flowchart schematically illustrating operations of the microcomputer 18*a* of the ECU 18 to carry out the third task in accordance with the third task program. The microcomputer 18*a* repeatedly runs the third task program in a preset cycle after it is activated in response to the turning on of an ignition switch of the motor vehicle as a trigger; this preset cycle corresponds to the clock cycle of the CPU or a preset crank angle.

When launching the third task program, the microcomputer 18*a* obtains the heat-exchanger inlet temperature Tex measured by the exhaust-emission temperature sensor 42, and calculates the catalyst temperature Tc based on the obtained heat-exchanger inlet temperature Tex and the recovery of heat from the exhaust emissions by the heat exchanger 40 in step S50. The recovery of heat from the exhaust emissions can be calculated based on the opening of the quantity regulating valve 41 and the coolant temperature Tw. For example, in step S50, the microcomputer 18*a* calculates, based on the calculated recovery of heat, the reduction in temperature by the heat exchange of the heat exchanger 40, and subtracts the reduction in temperature from the heat-exchanger inlet temperature Tex to thereby calculate the catalyst temperature Tc. In the third task illustrated in FIG. 7, the absorbent temperature Ta is considered to be identical to the catalyst temperature Tc.

Next, the microcomputer 18*a* determines whether the absorbent temperature Ta is lower than the desorbing temperature T1 in step S51. Upon determining that the absorbent temperature Ta is lower than the desorbing temperature T1 (Ta<T1, YES in step S51), the microcomputer 18*a* proceeds to step S52 and calculates the amount of the HC absorbed in the absorbent 32 in step S52. For example, in step S52, the microcomputer 18*a* calculates the amount of the HC absorbed in the absorbent 32 in the same operation as the operation in step S30.

Specifically, the microcomputer 18*a* calculates the amount of HC emissions exhausted from the engine 11 based on the parameters of the operating conditions of the engine 11, and calculates the HC absorption rate of the absorbent 32 based on the absorbent temperature Ta. Then, the microcomputer 18*a* multiplies the amount of HC emissions by the HC absorption rate to thereby calculate the amount of the HC absorbed in the absorbent 32.

Note that the absorbent 32 strictly starts to desorb the absorbed HC at a temperature (desorbing start temperature) lower than the desorbing temperature T1, but it is available for absorbing the HC at a temperature range lower than the desorbing temperature T1. Specifically, the absorbent 32 is available for absorbing and desorbing the HC with its temperature Ta being within a range from the desorbing start temperature of, for example, 100° C. to the desorbing temperature T1 of, for example, 150° C. The absorbent 32 is unavailable for absorbing the HC with its temperature Ta reaching the desorbing temperature T1. The HC absorption rate of the absorbent 32 is gradually reduced with increase in the absorbent temperature Ta that is within the temperature range, which is represented as 100° C.≤Ta<150° C. Thus, in step S52, the microcomputer 18*a* calculates the HC absorption rate of the absorbent 32 such that the HC absorption rate is reduced with increase in the absorbent temperature Ta.

Next, the microcomputer 18*a* determines whether the calculated amount of the HC absorbed in the absorbent 32 is smaller than the saturated amount of the HC therein in step S53. Upon determining that the calculated amount of the HC absorbed in the absorbent 32 is smaller than the saturated amount of the HC therein (YES in step S53), the microcomputer 18*a* instructs the quantity regulating valve 41 to adjust its opening in fully opened condition to thereby carry out the heat-recovery increase control so as to maximize the quantity of flow of the coolant to be circulated to the heat exchanger 40 in step S54.

To sum up, the absorbent 32 is available for absorbing the HC with its temperature Ta being lower than the desorbing temperature T1 and the amount of the HC absorbed in the absorbent 32 being smaller than the saturated amount of the HC. In other words, the absorbent 32 is unavailable for absorbing the HC with its temperature Ta equal to or higher than the desorbing temperature T1 even if the amount of the HC absorbed in the absorbent 32 is smaller than the saturated amount of the HC. Similarly, the absorbent 32 is unavailable for absorbing the HC with the amount of the HC absorbed in the absorbent 32 becoming the saturated amount of the HC even if the absorbent temperature Ta is lower than the desorbing temperature T1. The heat-recovery increase control is carried out as long as the absorbent 32 becomes available for absorbing the HC. This reduces the temperature Tout of the exhaust emissions entering the emission control device 30 to thereby reduce the catalyst temperature Tc and the absorbent temperature Ta. This results in delay of the arrival of the absorbent temperature Ta to the desorbing temperature T1, thus lengthening the time interval during which the absorbent 32 is available for absorbing the HC. This makes full use of the absorption capabilities of the absorbent 32.

Subsequently, the microcomputer 18*a* determines whether execution of the heat-recovery increase control permits holding of the time interval during which the absorbent 32 is available for absorbing the HC to be equal to or longer than a preset time interval in step S55. For example, in step S55, when the present absorbent temperature Ta at that time is equal to or lower than a threshold temperature TH3, the microcomputer 18*a* determines that execution of the heat-recovery control permits holding of the time interval during which the absorbent 32 is available for absorbing the HC to be equal to or longer than the preset time interval (YES in step S55). In step S55, the threshold temperature TH3 can be variably set depending on the present coolant temperature Tw. Specifically, because the amount of heat exchange by the heat exchanger 40 is increased with decrease in the coolant temperature Tw so that the temperature Tout of the exhaust emissions entering the emission control device 30 is significantly reduced, the microcomputer 18*a* changes the threshold temperature TH3 by increasing it with decrease in the coolant temperature Tw.

Otherwise, upon determining that execution of the heat-recovery control does not permit holding of the time interval during which the absorbent 32 is available for absorbing the HC to be equal to or longer than the preset time interval (NO in step S55), the microcomputer 18*a* proceeds to step S56. In step S56, the microcomputer 18*a* carries out the engine-output decrease control to thereby correct the normal target injection quantity of fuel for each cylinder by reducing it, thus decreasing the engine output. This reduces the temperature Tout of the exhaust emissions entering the emission control device 30 to thereby reduce the catalyst temperature Tc and the absorbent temperature Ta. This results in delay of the arrival of the absorbent temperature Ta to the desorbing temperature T1, making it possible to hold the time interval during which the absorbent 32 is available for absorbing the HC to be equal to or longer than the preset time interval.

Otherwise, upon determining that the absorbent 32 is unavailable for absorbing the HC by determining that the absorbent temperature Ta is equal to or higher than the desorbing temperature T1 (Ta≥T1, NO in step S51) or the calculated amount of the HC absorbed in the absorbent 32 is equal to or greater than the saturated amount of the HC therein (NO in step S53), the microcomputer 18*a* exits the third task without executing the heat-recovery increase control in step S54 and the engine-output decrease control in step S56.

Upon determining that the absorbent 32 is available for absorbing the HC by determining that the absorbent temperature Ta is lower than the desorbing temperature T1 (Ta<T1, YES in step S51) and the calculated amount of the HC absorbed in the absorbent 32 is smaller than the saturated amount of the HC therein (YES in step S53), but determining that execution of the heat-recovery control permits holding of the time interval during which the absorbent 32 is available for absorbing the HC to be equal to or longer than the preset time interval YES in step S55), the microcomputer 18*a* executes the heat-recovery increase control in step S54 without executing the engine-output decrease control in step S56.

Next, an example of the operations illustrated in FIG. 7 will be described hereinafter with reference to a timing chart of FIG. 8. (a) of FIG. 8 illustrates the change in drive power for the motor vehicle with time, (b) of FIG. 8 illustrates the change in the engine output with time, and (c) of FIG. 8 illustrates the change in the quantity of heat of the exhaust emissions immediately downstream of the engine 11 with time.

Figure 8:
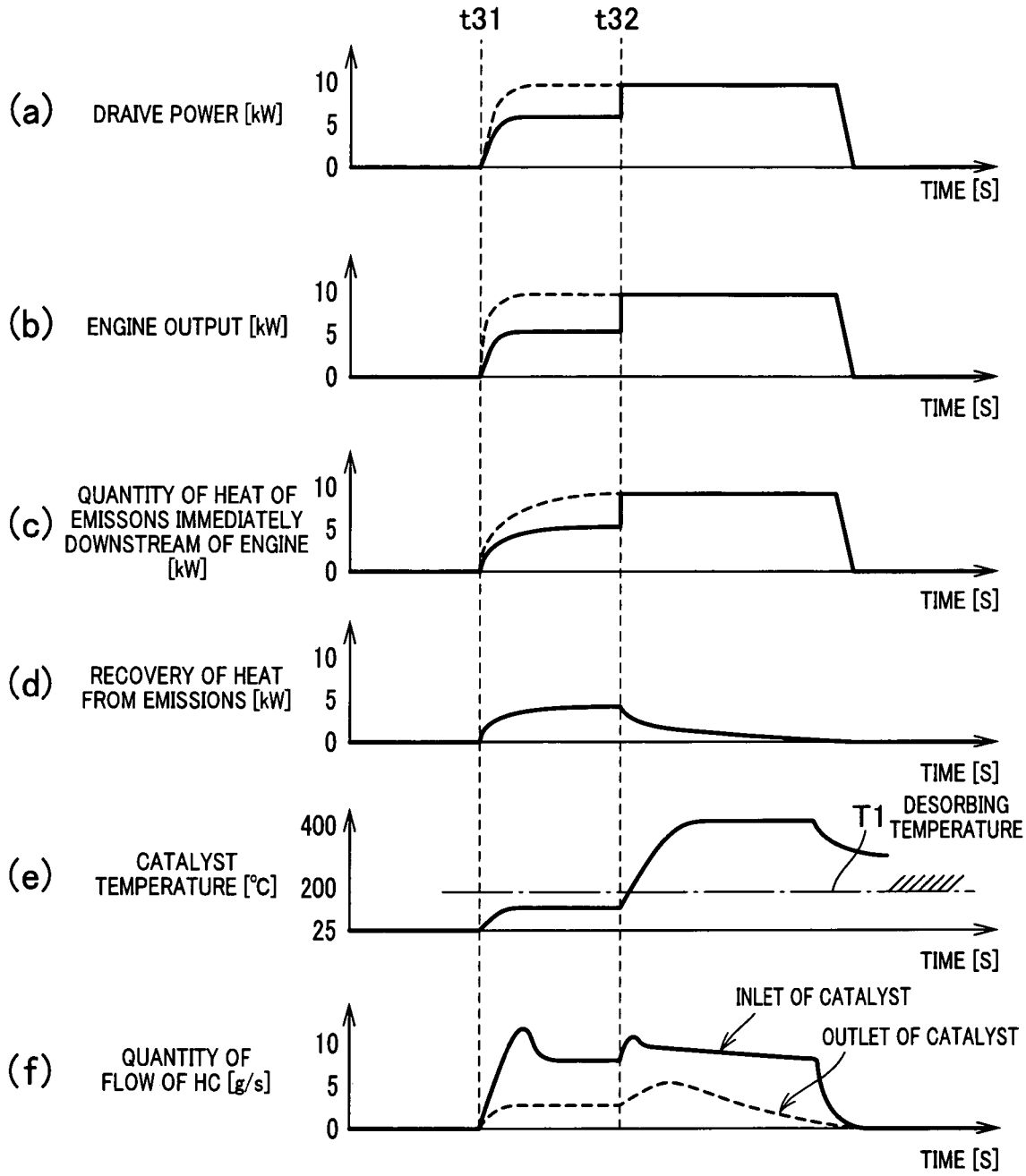
FIG. 8 is a timing chart schematically illustrating an example of the operations of the microcomputer illustrated in FIG. 7.

(d) of FIG. 8 illustrates the change in the recovery of heat from the exhaust emissions immediately downstream of the engine 11, and (e) of FIG. 8 illustrates the change in the catalyst temperature Tc with time. The solid line in (f) of FIG. 8 illustrates the change in the quantity of flow of the HC entering the catalyst 33 with time, and the dashed line in (f) of FIG. 8 illustrates the change in the quantity of flow of the HC out of the catalyst 33 with time.

Referring to FIG. 8, the heat-recovery increase control and the engine-output decrease control are started when the engine 11 is started at time t31. Thereafter, when the temperature of the exhaust emissions immediately downstream of the engine 11, which corresponds to the heat-exchanger inlet temperature Tex, reaches the desorbing temperature T1 at time t32, or the calculated catalyst temperature Tc, that is, the absorbent temperature Ta, reaches the desorbing temperature T1, the heat-recovery increase control and the engine-output decrease control are terminated.

Execution of the engine-output decrease control within a period from time t31 to time t32 allows the engine output and the drive power to decrease from their values illustrated by dashed lines to their values illustrated by the solid lines (see (a) and (b) of FIG. 8). This results in a decrease in the quantity of heat of the exhaust emissions immediately downstream of the engine 11, which corresponds to the heat-exchanger inlet temperature Tex, from its value illustrated by dashed line to its value illustrated by the solid line (see (c) of FIG. 8). In addition, execution of the heat-recovery increase control within the period from time t31 to time t32 allows the recovery of heat from the exhaust emissions immediately downstream of the engine 11 to increase (see (d) of FIG. 8).

Thus, as illustrated in (e) of FIG. 8, it is possible to lengthen the period from time t31 to time t32 during the catalyst temperature Tc being lower than the desorbing temperature T1, thus increasing the quantity of flow of the HC to be absorbed in the absorbent 32. That is, it is possible to significantly reduce the quantity of flow of the HC out of the emission control device 30 illustrated by the dashed line in (f) of FIG. 8 relative to the quantity of flow of the HC entering the emission control device 30 illustrated by the solid line in (f) of FIG. 8.

As described above, the emission control system according to the third embodiment is provided with the heat exchanger 40 located upstream of the emission control device 30, and configured to regulate the quantity of flow of the coolant to be circulated to the heat exchanger 40 to thereby adjust the recovery of heat from the exhaust emissions. This adjustment of the recovery of heat allows adjustment of the temperature (heat-exchanger outlet temperature Tout) of the exhaust emissions entering the emission control device 30.

In addition, the emission control system according to the third embodiment is configured to maximize the quantity of flow of the coolant to be circulated to the heat exchanger 40 with the engine output being reduced. This configuration blunts the rise in the temperature of the exhaust emissions entering the emission control device 30. Thus, it is possible to lengthen the time until the absorbent temperature Ta reaches the desorbing temperature T1, and therefore to increase the amount of the HC to be absorbed in the absorbent 32. This makes full use of the absorption capabilities of the absorbent 32. Note that, while the catalyst temperature Tc is equal to or higher than the activation temperature T2, the emission control system is configured to minimize the quantity of flow of the coolant to be circulated to the heat exchanger 40 to zero, thus facilitating the rise in the temperature of the exhaust emissions entering the emission control device 30. This configuration reduces the time until the catalyst temperature Tc reaches the activation temperature T2, thus early completing the catalyst warm-up control.

The emission control system according to the third embodiment is configured to minimize the quantity of flow of the coolant to be circulated to the heat exchanger 40 to zero with the absorbent 32 being unavailable for absorbing the HC, such as being saturated, even if the absorbent temperature Ta is lower than the desorbing temperature T1, thus facilitating the rise in the temperature of the exhaust emissions entering the emission control device 30. This configuration facilitates the catalyst temperature Tc immediately without waiting for the arrival of the absorbent temperature Ta to the desorbing temperature T1. This reduces a dead period during which no absorption and oxidation are carried out, resulting in early completion of the catalyst warm-up control.

Note that execution of the engine-output decrease control may reduce the engine output against the driver's output requirement to provide uncomfortable feelings to the driver. However, the emission control system according to the third embodiment is configured to carry out only the heat-recovery increase control without executing the engine-output decrease control as long as only execution of the heat-recovery control permits holding of the time interval during which the absorbent 32 is available for absorbing the HC to be equal to or longer than the preset time interval (YES in step S55). This makes full use of the absorption capabilities of the absorbent 32 while reducing such concerns.

The emission control system according to the third embodiment is configured to maximize the quantity of flow of the coolant to be circulated to the heat exchanger 40 until the absorbent temperature Ta reaches the desorbing temperature T1, thus sufficiently increasing the recovery of heat by the heat exchanger 40. This allows the air conditioner to early use the coolant as its heart source, thus reducing the period from the engine start-up timing t1 to the time at which the temperature of the cabin reaches its target temperature.

Fourth Embodiment

Figure 9:
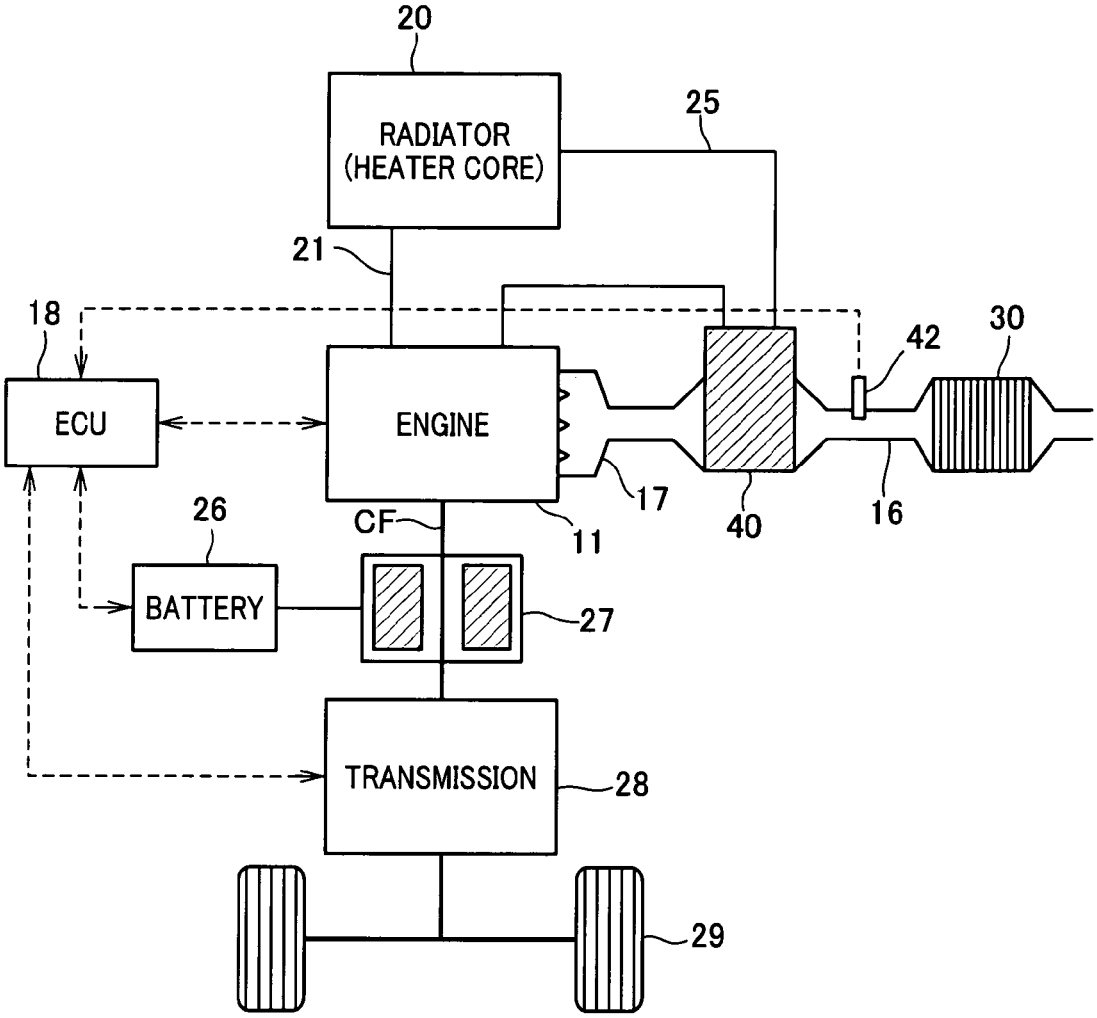
FIG. 9 is a structural view schematically illustrating an engine control system incorporating an emission control system according to the fourth embodiment of the present invention.
Figure 10:
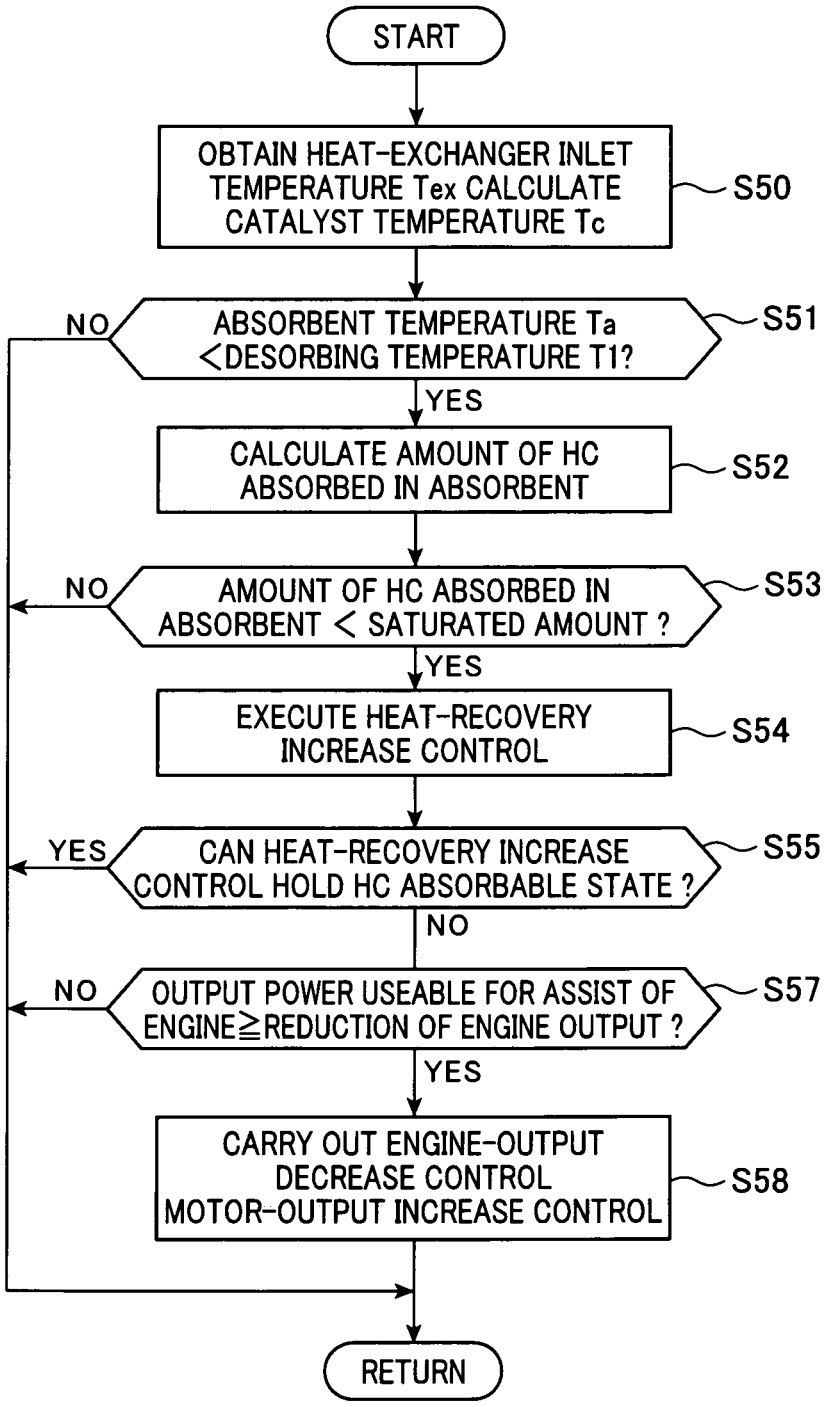
FIG. 10 is a flowchart schematically illustrating operations of the microcomputer to carry out a fourth task in accordance with a fourth task program according to the fourth embodiment.

An emission control system according to the fourth embodiment of the present invention will be described hereinafter with reference to FIGS. 9 to 11.

The structure and/or functions of the emission control system according to the fourth embodiment according to the third embodiment are different from the emission control system by the following points. So, the different points will be mainly described hereinafter.

First, the schematic structure of the engine control system according to the fourth embodiment will be described hereinafter. In the fourth embodiment, the engine control system is installed in a hybrid vehicle. In the hybrid vehicle, a motor-generator 27 and a battery 26 are installed. The hybrid vehicle is driven by the output power of the engine 11 and the output power of the motor-generator 27 driven based on electric power supplied from the battery 26. The output power of the engine 11 allows the motor-generator 26 to operate as a generator to generate electric power, and the battery 26 is chargeable based on the generated electric power. In FIG. 9, a crankshaft (output shaft) CF of the engine 11 is rotatable based on the output power of the engine 11 while being assisted by the output power of the motor-generator 27. The rotation of the crankshaft CF is transferred via a transmission 28 installed in the hybrid vehicle to driving wheels 29 linked to the transmission 28 so that the driving wheels 29 are driven based on the rotation of the crankshaft CF. Note that, in the fourth embodiment, the exhaust-emission temperature sensor 42 is provided in the exhaust pipe 16 at the downstream of the heat exchanger 40.

The ECU 18 is electrically connected to the battery 26, and is operative to control the SOC (State Of Charge) of the battery 26 within a preset range; this SOC means the available capacity in the battery 26 and is expressed as a percentage of the rated capacity. Particularly, when the SOC of the battery 26, which represents the charging rate thereof, is lower than a lower limit of the preset range, the ECU 18 causes the motor-generator 27 to operate as a generator based on the output power of the engine 11 to generate electric power, thus charging the battery 26 based on the generated electric power. Thus, during the battery 26 being charged based on the electric power generated by the motor-generator 27, the hybrid vehicle is driven without assistance of the motor-generator 27.

The emission control system according to the fourth embodiment is configured to carry out the engine-output decrease control while assisting the engine 11 with the motor-generator 27 as long as the SOC is kept within the preset range. Particularly, the emission control system according to the fourth embodiment is preferably configured to compensate the reduction of the engine output due to the engine-output decrease control by the output power generated by the motor-generator 27.

Next, a fourth task of the heat-recovery increase control and the engine-output decrease control to be executed by the ECU 18 in accordance with a fourth task program stored in the storage medium according to the fourth embodiment will be described hereinafter with reference to FIG. 10. FIG. 10 is a flowchart schematically illustrating operations of the microcomputer 18*a* of the ECU 18 to carry out the fourth task in accordance with the fourth task program. In comparison to the flowchart illustrated in FIG. 7, an operation in step S57 is added in the flowchart illustrated in FIG. 10, and the operation in step S56 of the flowchart illustrated in FIG. 7 is replaced with an operation in step S58 in the flowchart illustrated in FIG. 10. Some operations in the flowchart of FIG. 10, which are identical to those in the flowchart of FIG. 7, are labeled by step numbers identical to those in the flowchart of FIG. 7, and therefore, the descriptions of them in the flowchart of FIG. 10 are omitted or simplified in description.

Upon determining that the absorbent 32 is available for absorbing the HC based on the operations in steps S50 to S53, the microcomputer 18*a* carries out the heat-recovery increase control in step S54. Thereafter, upon determining that execution of the heat-recovery control does not permit holding of the time interval during which the absorbent 32 is available for absorbing the HC to be equal to or longer than the preset time interval (NO in step S55), the microcomputer 18*a* proceeds to step S57.

In step S57, the microcomputer 18*a* determines whether the motor-generator 27 would be capable of assisting the reduction of the engine output due to the engine-output decrease control if the engine-output decrease control were executed. Specifically, the microcomputer 18*a* determines whether the SOC of the battery 26 would be sufficient to allow the motor-generator 27 to assist the reduction of the engine output if the engine-output decrease control were executed in step S57. For example, in step S57, the microcomputer 18*a* determines whether the SOC of the battery 26 would be equal to or higher than a preset value that allows the motor-generator 27 to compensate for predetermined electric power corresponding to the reduction of the engine output (the reduction of fuel quantity for each cylinder) due to the engine-output decrease control if the engine-output decrease control were executed.

Upon determining that the motor-generator 27 would be capable of assisting the reduction of the engine output due to the engine-output decrease control, in other words, the output power of the motor-generator 27 useable for the assist of the engine 11 from the battery 26 would be equal to or greater than the predetermined electric power corresponding to the reduction of the engine output (YES in step S57), the microcomputer 18*a* proceeds to step S58. In step S58, the microcomputer 18*a* carries out the engine-output decrease control, and carries out control to increase electric power to be supplied from the battery 26 to the motor-generator 27 so as to compensate for the reduction of the engine output by the output power of the motor-generator 27. The control to increase electric power to be supplied from the battery 26 to the motor-generator 27 so as to compensate for the reduction of the engine output by the output power of the motor-generator 27 will be referred to as "motor-output increase control" hereinafter.

Otherwise, upon determining that the output power of the motor-generator 27 useable for the assist of the engine 11 from the battery 26 would be less than the predetermined electric power corresponding to the reduction of the engine output, that is, the SOC of the battery 26 would be lower than the preset value (NO in step S57), the microcomputer 18*a* disables execution of both the engine-output decrease control and the motor-output increase control in step S58, terminating the fourth task.

Next, an example of the operations illustrated in FIG. 10 will be described hereinafter with reference to a timing chart of FIG. 11. (a) of FIG. 11 illustrates the change in drive power for the motor vehicle with time, (b) of FIG. 11 illustrates the change in the engine output with time, and (c) of FIG. 11 illustrates the change in the amount of charge into the battery 26 and in the amount of discharge therefrom with time. (d) of FIG. 11 illustrates the change in the quantity of heat of the exhaust emissions immediately downstream of the engine 11 with time, (e) of FIG. 11 illustrates the change in the recovery of heat by the heat exchanger 40, and (f) of FIG. 11 illustrates the change in the catalyst temperature Tc with time. The solid line in (g) of FIG. 11 illustrates the change in the quantity of flow of the HC entering the catalyst 33 with time, and the dashed line in (g) of FIG. 11 illustrates the change in the quantity of flow of the HC out of the catalyst 33 with time.

Figure 11:
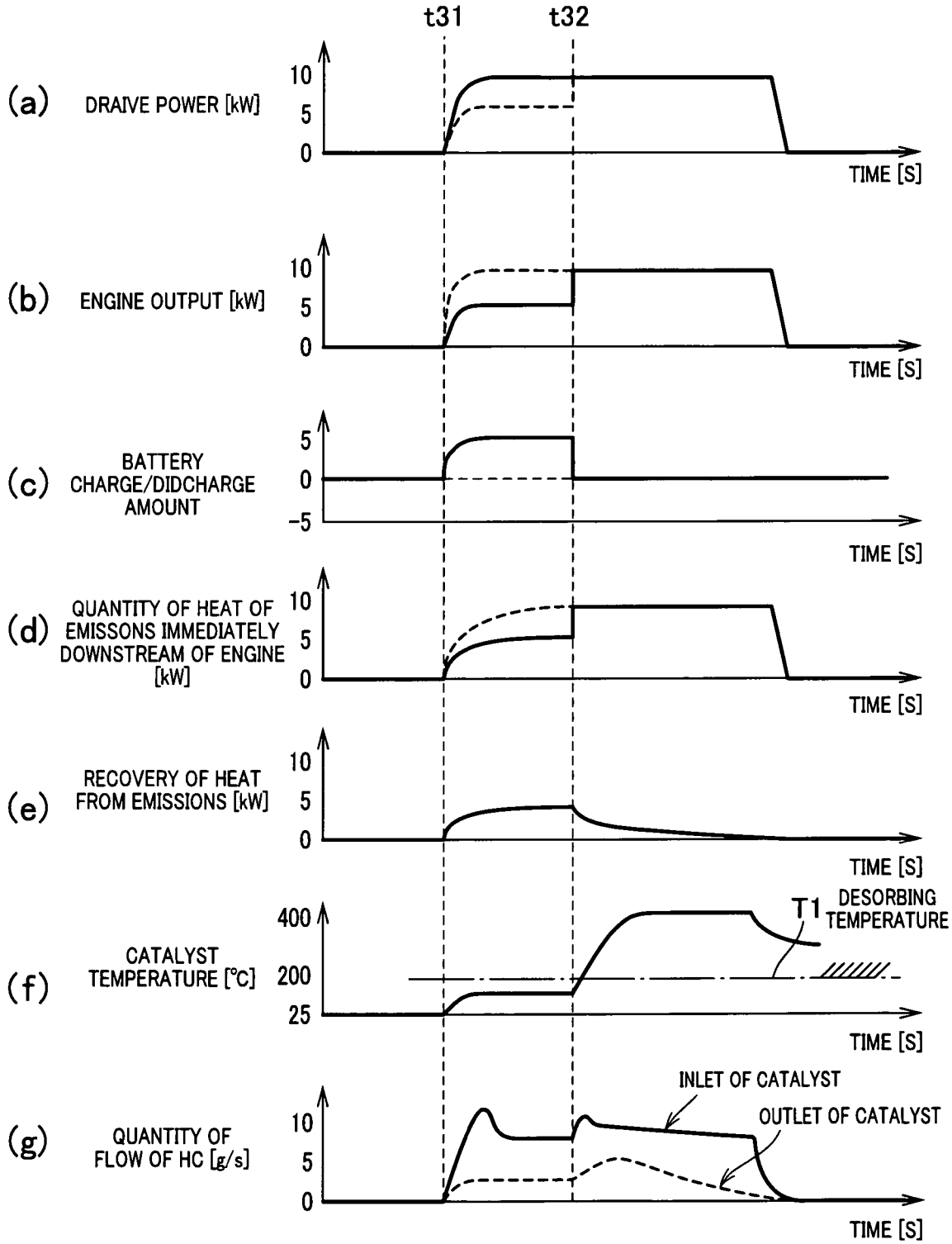
FIG. 11 is a timing chart schematically illustrating an example of the operations of the microcomputer illustrated in FIG. 10.

Referring to FIG. 11, the heat-recovery increase control, the engine-output decrease control, and the motor-output increase control are started when the engine 11 is started at time t31. Thereafter, when the temperature of the exhaust emissions immediately downstream of the engine 11, which corresponds to the heat-exchanger inlet temperature Tex, reaches the desorbing temperature T1 at time t32, or the calculated catalyst temperature Tc, that is, the absorbent temperature Ta, reaches the desorbing temperature T1, the heat-recovery increase control, the engine-output decrease control, and the motor-output increase control are terminated.

Execution of the heat-recovery increase control within a period from time t31 to time t32 allows the recovery of heat by the heat exchanger 40 to increase (see (e) of FIG. 11). In addition, execution of the motor-output increase control to increase the amount of discharge from the battery 26 within the period from time t31 to time t32 prevents, even execution of the engine-output decrease control as illustrated in (b) of FIG. 11, the reduction in the drive power for the motor vehicle; this reduction is illustrated by the dash line in (a) of FIG. 11. Thus, it is possible to maintain the drive power as illustrated in the solid line in (a) of FIG. 11 at driver's required drive power.

Execution of the heat-recovery increase control and the engine-output decrease control lengthens the period from time t31 to time t32 during the catalyst temperature Tc being lower than the desorbing temperature T1, thus increasing the quantity of flow of the HC to be absorbed in the absorbent 32. That is, it is possible to significantly reduce the quantity of flow of the HC out of the emission control device 30 illustrated by the dashed line in (g) of FIG. 11 relative to the quantity of flow of the HC entering the emission control device 30 illustrated by the solid line in (g) of FIG. 11. In addition, it is possible to maintain the drive power for the hybrid vehicle at driver's required drive power.

In addition, execution of the motor-output increase control prevents actual drive power for the hybrid vehicle from being less than driver's required drive power therefor. Particularly, when the output power of the motor-generator 27 useable for the assist of the engine 11 from the battery 26 is less than the predetermined electric power corresponding to the reduction of the engine output (NO in step S57), execution of the engine-output decrease control is disabled, making it possible to reliably prevent actual drive power for the hybrid vehicle from being less than driver's required drive power therefor.

Fifth Embodiment

Figure 12:
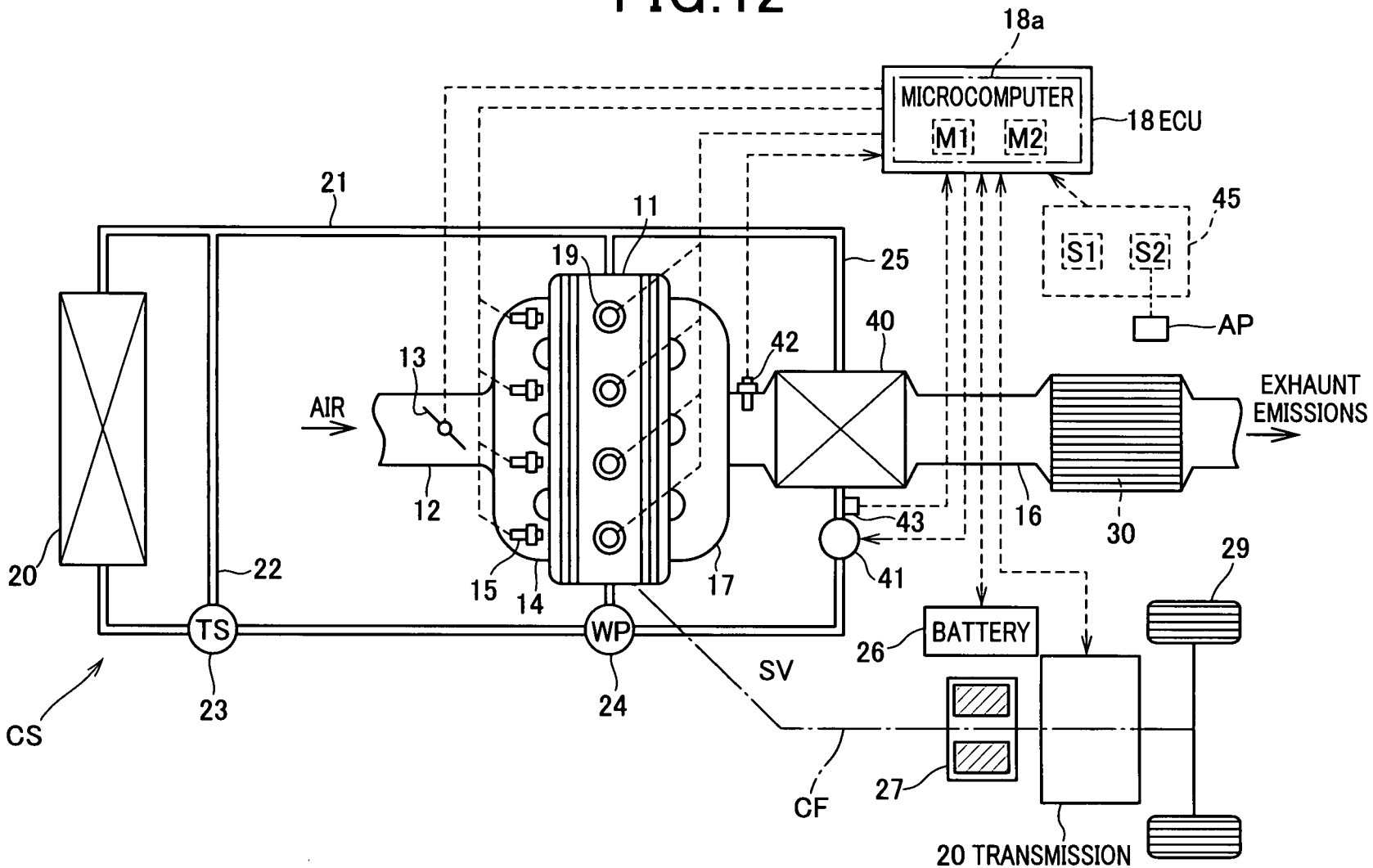
FIG. 12 is a structural view schematically illustrating an engine control system incorporating an emission control system according to the fifth embodiment of the present invention.
Figure 13:
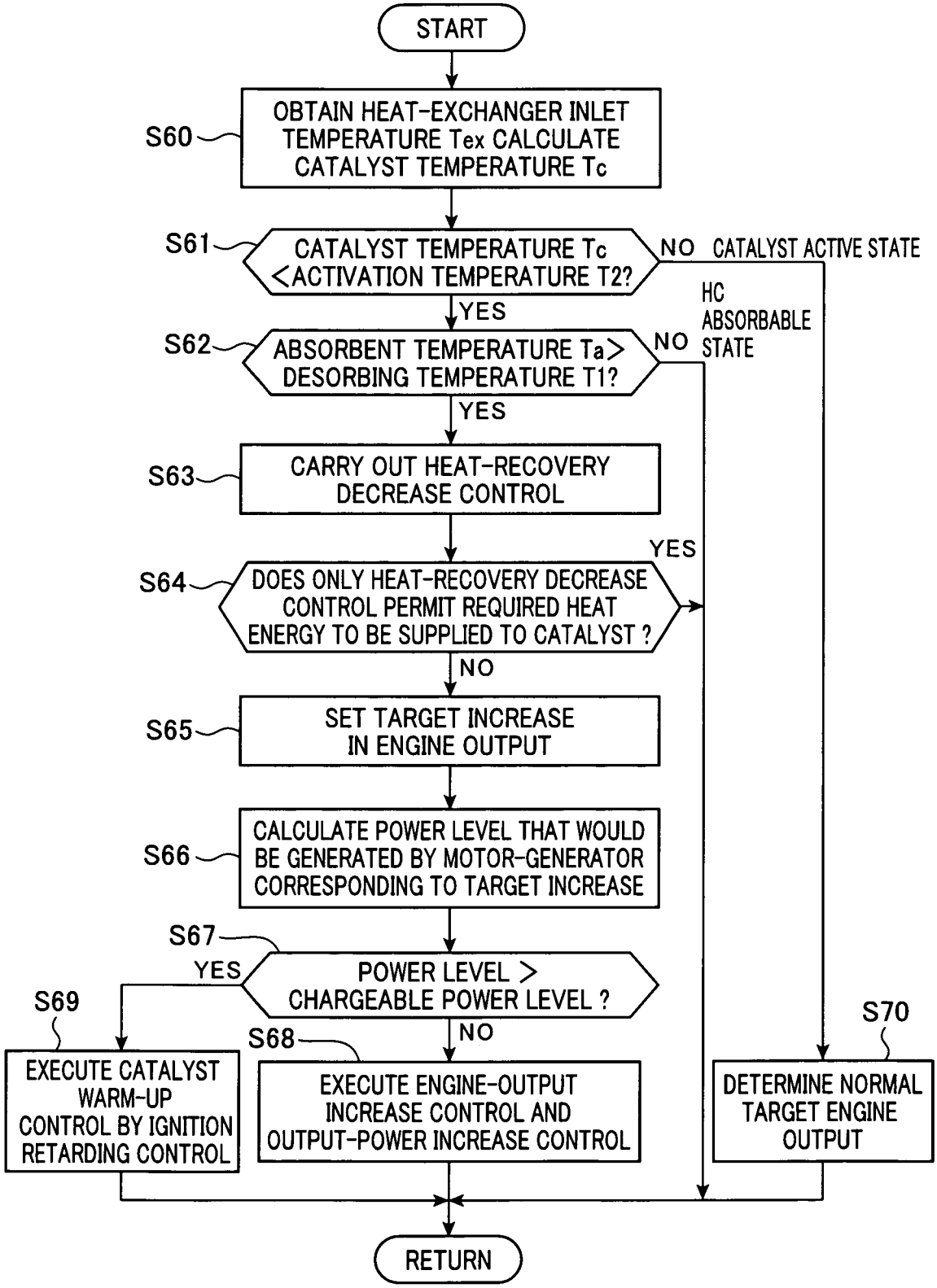
FIG. 13 is a flowchart schematically illustrating operations of the microcomputer to carry out a fifth task in accordance with a fifth task program according to the fifth embodiment.

An emission control system according to the fifth embodiment of the present invention will be described hereinafter with reference to FIGS. 12 to 14.

The structure and/or functions of the emission control system according to the fifth embodiment are different from the emission control system according to the third embodiment by the following points. So, the different points will be mainly described hereinafter.

First, the schematic structure of the engine control system according to the fifth embodiment will be described hereinafter. In the fifth embodiment, as well as the fourth embodiment, the engine control system is installed in a hybrid vehicle. In the hybrid vehicle, the motor-generator 27 and the battery 26 are installed. The hybrid vehicle is driven by the output power of the engine 11 and the output power of the motor-generator 27 driven based on electric power supplied from the battery 26. The output power of the engine 11 allows the motor-generator 26 to operate as a generator to generate electric power, and the battery 26 is chargeable based on the generated electric power. In FIG. 12, the crankshaft (output shaft) CF of the engine 11 is rotatable based on the output power of the engine 11 while being assisted by the output power of the motor-generator 27. The rotation of the crankshaft CF is transferred via the transmission 28 installed in the hybrid vehicle to the driving wheels 29 linked to the transmission 28 so that the driving wheels 29 are driven based on the rotation of the crankshaft CF.

The ECU 18 is electrically connected to the battery 26, and is operative to control the SOC of the battery 26 within the preset range. Particularly, when the SOC of the battery 26, which represents the charging rate thereof, is lower than the lower limit of the preset range, the ECU 18 causes the motor-generator 27 to operate as a generator based on the output power of the engine 11 to generate electric power, thus charging the battery 26 based on the generated electric power. Thus, during the battery 26 being charged based on the electric power generated by the motor-generator 27, the hybrid vehicle is driven without assistance of the motor-generator 27. In addition, when the SOC of the battery 26 is 100% or higher than the upper limit of the preset range of the SOC, the ECU 18 disables charging of the battery 26 or disables generation of the motor-generator 27 in order to prevent overcharging of the battery 2. This prevents the battery 26 from being deteriorated due to overcharging.

As described above, if the catalyst warm-up control, such as the ignition retarding control for retarding the target ignition timing of each spark plug 19, were executed at cold start of the engine 11, fuel economy would be reduced.

In order to address this problem, the emission control system according to the fifth embodiment is designed to carry out the following "heat-recovery decrease control", "engine-output increase control", and "output-power increase control (load increase control)" after the arrival of the absorbent temperature Ta to the desorbing temperature T1. Note that the absorbent temperature Ta and the catalyst temperature Tc are estimated based on the heat-exchanger inlet temperature Tex measured by the exhaust-emission temperature sensor 42 and the recovery of exhaust heat from the exhaust emissions in the same manner as the third embodiment.

The heat-recovery decrease control is to stop the circulation of the coolant to the heat exchanger 40 or reduce the quantity of flow of the coolant to be circulated through the heat exchanger 40 to minimize the recovery of heat by the heat exchanger 40. This increases the heat-exchanger inlet temperature Tex. The engine-output increase control is to correct the normal target injection quantity of fuel for each cylinder computed based on the map M1 by increasing it, thus increasing the engine output. This increases the heat-exchanger inlet temperature Tex to accelerate the arrival of the catalyst temperature Tc to the activation temperature T2, resulting in early completion of the catalyst warm-up control. The output-power increase control is to increase the output power of the motor-generator 27 by a power level corresponding to the increase in the engine output by the engine-output increase control.

After the arrival of the catalyst temperature Tc to the activation temperature T2, the emission control system according to the fifth embodiment is designed to terminate both the engine-output increase control and the output-power increase control, and thereafter, instructs the fuel injector 15 for each cylinder to spray, at the target injection timing, the normal target injection quantity of fuel.

Next, a fifth task of the heat-recovery decrease control, the engine-output increase control, and the output-power increase control to be executed by the ECU 18 in accordance with a fifth task program stored in the storage medium will be described hereinafter with reference to FIG. 13. FIG. 13 is a flowchart schematically illustrating operations of the microcomputer 18*a* of the ECU 18 to carry out the fifth task in accordance with the fifth task program. The microcomputer 18*a* repeatedly runs the fifth task program corresponding to the fifth task in a preset cycle after it is activated in response to the turning on of an ignition switch of the motor vehicle as a trigger; this preset cycle corresponds to the clock cycle of the CPU or a preset crank angle.

When launching the fifth task program, the microcomputer 18*a* obtains the heat-exchanger inlet temperature Tex measured by the exhaust-emission temperature sensor 42, and calculates the catalyst temperature Tc based on the obtained heat-exchanger inlet temperature Tex and the recovery of heat from the exhaust emissions by the heat exchanger 40 in step S60. The recovery of heat from the exhaust emissions can be calculated based on the opening of the quantity regulating valve 41 and the coolant temperature Tw. For example, in step S60, the microcomputer 18*a* calculates, based on the calculated recovery of heat, the reduction in temperature by the heat exchange of the heat exchanger 40, and subtracts the reduction in temperature from the heat-exchanger inlet temperature Tex to thereby calculate the catalyst temperature Tc. In the fifth task illustrated in FIG. 13, the absorbent temperature Ta is considered to be identical to the catalyst temperature Tc.

Next, the microcomputer 18*a* determines whether the catalyst temperature Tc calculated in step S60 is lower than the activation temperature T2 in step S61. Upon determining that the catalyst temperature Tc is lower than the activation temperature T2 (Tc<T2, YES in step S61), the microcomputer 18*a* proceeds to step S62 and determines whether the absorbent temperature Ta calculated in step S60 is higher than the desorbing temperature T1 in step S62. As described above, because the absorbent temperature Ta is considered to be identical to the catalyst temperature Tc, the microcomputer 18*a* determines whether the catalyst temperature Tc is higher than the desorbing temperature T1 in step S62.

Upon determining that the catalyst temperature Tc (absorbent temperature Ta) is higher than the desorbing temperature T1 (Tc>T1, YES in step S62), the microcomputer 18*a* determines that an increase in the catalyst temperature Tc is required for the catalyst warm-up control. Then, the microcomputer 18*a* proceeds to step S63, and instructs the quantity regulating valve 41 to adjust its opening in fully closed condition to thereby carry out the heat-recovery decrease control.

That is, when the catalyst temperature Tc is lower than the activation temperature T2 and the absorbent temperature Ta is higher than the desorbing temperature T1, the microcomputer 18*a* determines that the catalyst 33 is not available for purifying the HC even if the HC is desorbed from the absorbent 32. Then, the microcomputer 18*a* carries out the heat-recovery decrease control to thereby early complete the catalyst warm-up control. The execution of the heat-recovery decrease control facilitates the rise in the heat-exchanger inlet temperature Tex, and the rise in each of the catalyst temperature Tc and the absorbent temperature Ta. This reduces the time until the catalyst temperature Tc reaches the activation temperature T2.

Otherwise, upon determining that the catalyst temperature Tc (absorbent temperature Ta) is equal to or lower than the desorbing temperature T1 (Tc≤T1, NO in step S62), the microcomputer 18*a* determines that the absorbent 32 works to absorb the HC, and therefore, the microcomputer 18*a* terminates the fifth task. Note that, when it is determined that the amount of the HC reaches the saturated amount, the microcomputer 18*a* can proceeds to step S63 and carry out the heat-recovery decrease control.

Upon determining that the catalyst temperature Tc is equal to or higher than the activation temperature T2 (Tc≥T2, NO in step S61), the microcomputer 18*a* proceeds to step S70, and controls the engine 11 so that the engine output is matched with a preset normal target engine output. For example, the microcomputer 18*a* instructs the fuel injector 15 for each cylinder to spray, at the target injection timing, the normal target injection quantity of fuel without executing the catalyst warm-up control based on the ignition retarding control.

After completion of the operation in step S63, the microcomputer 18*a* determines whether only execution of the heat-recovery decrease control permits required heat energy to be sufficiently supplied to the catalyst 33 in step S64. Specifically, the microcomputer 18*a* calculates the time required for the catalyst temperature Tc to reach the activation temperature T2 based on the present catalyst temperature Tc and heat energy to be supplied to the catalyst 33 by the exhaust emissions whose temperature has been increased by the heat-recovery decrease control. Upon determining that the calculated time is within a preset time interval, the microcomputer 18*a* determines that only execution of the heat-recovery decrease control permits the required heat energy to be sufficiently supplied to the catalyst 33 in step S64.

When the affirmative determination is carried out in step S64, the microcomputer 18*a* terminates the fifth task without executing the engine-output increase control and the catalyst warm-up control based on the ignition retarding control. Otherwise, when the negative determination is carried out in step S64, the microcomputer 18*a* proceeds to step S65, and sets (calculates) a target increase in the engine output to be used for the engine-output increase control. Next, the microcomputer 18*a* calculates a power level that would be generated by the motor-generator 27 in step S66 if the engine-output increase control were executed; this power level corresponds to the target increase in the engine output to be used for the engine-output increase control.

Next, the microcomputer 18*a* determines whether the calculated power level in step S66 is greater than a power level chargeable in the battery 26, in other words, whether, if the calculated power level in step S66 were charged into the battery 26, a present value of the SOC of the battery 26 exceeds the upper limit of the SOC in step S67.

Upon determining that the calculated power level in step S66 is equal to or smaller than the power level chargeable in the battery 26 (NO in step S67), the microcomputer 18*a* proceeds to step S68 and carries out the engine-output increase control and the output-power increase control in step S68. Otherwise, upon determining that the calculated power level in step S66 is greater than the power level chargeable in the battery 26 (YES in step S67), the microcomputer 18*a* proceeds to step S69 and carries out the catalyst warm-up control by executing the ignition retarding control to increase the temperature of the exhaust emissions without executing the engine-output increase control and the output-power increase control in step S69.

As described above, when the microcomputer 18*a* does not execute the engine-output increase control, the microcomputer 18*a* instructs the fuel injector 15 for each cylinder to spray, at the target injection timing, the normal target injection quantity of fuel calculated based on the map M1. The engine-output increase control is to correct the normal target injection quantity of fuel for each cylinder calculated based on the map M1 by increasing it, thus increasing the engine output. The output-power increase control is to increase the output power of the motor-generator 27 by a power level corresponding to the increase in the engine output by the engine-output increase control.

Next, an example of the operations illustrated in FIG. 13 will be described hereinafter with reference to a timing chart of FIG. 14. (a) of FIG. 14 illustrates the change in the vehicle speed with time, (b) of FIG. 14 illustrates the change in the engine output with time, and (c) of FIG. 14 illustrates the change in the amount of charge into the battery 26 and in the amount of discharge therefrom with time. (d) of FIG. 14 illustrates the change in the quantity of heat of the exhaust emissions immediately downstream of the engine 11, (e) of FIG. 14 illustrates the change in the recovery of heat by the heat exchanger 40, and (f) of FIG. 14 illustrates the change in the catalyst temperature Tc with time. The solid line in (g) of FIG. 14 illustrates the change in the quantity of flow of the HC entering the catalyst 33 with time, and the dashed line in (g) of FIG. 14 illustrates the change in the quantity of flow of the HC out of the catalyst 33 with time.

Figure 14:
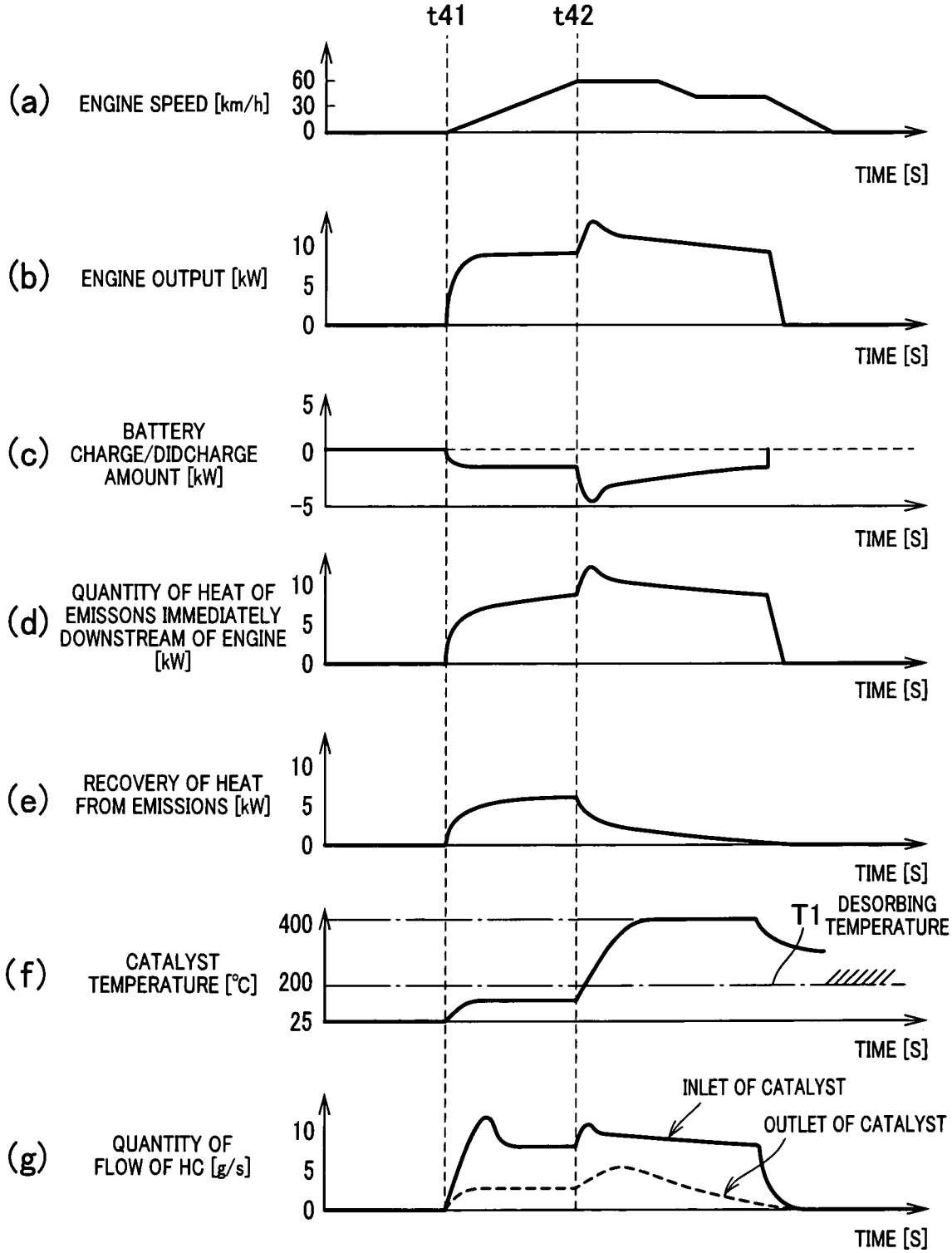
FIG. 14 is a timing chart schematically illustrating an example of the operations of the microcomputer illustrated in FIG. 13.

Referring to FIG. 14, the heat-recovery increase control and the engine-output decrease control are started when the engine 11 is started at time t41. That is, the heat-recovery increase control maximizes the quantity of flow of the coolant to be circulated through the heat exchanger 40 to carry out exhaust heat recovery at the full capacity of the engine cooling system CS. This reduces the temperature of the exhaust emissions entering the emission control device 30. The engine-output decrease control corrects the normal target injection quantity of fuel for each cylinder computed based on the map M1 by reducing it, thus reducing the engine output. This reduces the temperature of the exhaust emissions entering the emission control device 30.

Execution of the heat-recovery increase control within a period from time t41 to time t42 allows the recovery of heat by the heat exchanger 40 to increase (see (e) of FIG. 14). In addition, execution of the motor-output increase control to increase the amount of discharge from the battery 26 within the period from time t41 to time t42 prevents, even execution of the engine-output decrease control, the reduction of the drive power for the motor vehicle. Thus, it is possible to maintain the drive power at driver's required drive power. Thereafter, when the temperature of the exhaust emissions immediately downstream of the engine 11, which corresponds to the heat-exchanger inlet temperature Tex, reaches the desorbing temperature T1 at time t42, or the calculated catalyst temperature Tc, that is, the absorbent temperature Ta, reaches the desorbing temperature T1, the heat-recovery increase control and the engine-output decrease control are terminated.

Thereafter, when the temperature of the exhaust emissions immediately downstream of the engine 11, which corresponds to the heat-exchanger inlet temperature Tex, reaches the desorbing temperature T1 at time t42, the heat-recovery decrease control and the engine-output increase control are carried out. Thereafter, when the catalyst temperature Tc reaches the activation temperature T2, the heat-recovery decrease control and the engine-output increase control are terminated.

Execution of the heat-recovery decrease control after time t42 allows the recovery of heat by the heat exchanger 40 to decrease (see (e) of FIG. 14). In addition, execution of the engine-output increase control (see (b) of FIG. 14) after time t42 allows the quantity of heat of the exhaust emissions immediately downstream of the engine 11 to increase (see (d) of FIG. 14). Execution of the heat-recovery decrease control and the engine-output increase control results in an immediate increase in the catalyst temperature Tc from time t42 (see (f) of FIG. 14). Thus, it is possible to facilitate the rise in the temperature of the exhaust emissions without retarding the target ignition timing or with reduction in an amount of retardation of the target ignition timing. This results in early completion of the catalyst warm-up control while inhibiting the reduction in fuel economy due to the retardation of the ignition timing.

After time t42, the output-power increase control is carried out so that the amount of charge in the battery 26 is increased (see (c) of FIG. 14). Thus, it is possible to prevent an increase in actual drive power for the hybrid vehicle relative to driver's required drive power. This prevents giving uncomfortable feelings to the driver.

As described above, the emission control system according to the fifth embodiment is provided with the heat exchanger 40 located upstream of the emission control device 30, and configured to regulate the quantity of flow of the coolant to be circulated to the heat exchanger 40 to thereby adjust the recovery of heat from the exhaust emissions. This adjustment of the recovery of heat allows adjustment of the temperature (heat-exchanger outlet temperature Tout) of the exhaust emissions entering the emission control device 30.

In addition, the emission control system according to the fifth embodiment is configured to carry out: the heat-recovery decrease control to thereby maximize the quantity of flow of the coolant to be circulated to the heat exchanger 40 to zero, and the engine-output increase control to thereby increase the engine output after the arrival of the absorbent temperature Ta to the desorbing temperature T1. This configuration facilitates the rise in the temperature of the exhaust emissions entering the emission control device 30, thus reducing the time until the catalyst temperature Tc reaches the activation temperature T2. This facilitates the rise in the temperature of the exhaust emissions without retarding the target ignition timing or with reduction in an amount of retardation of the target ignition timing, making it possible to early complete the catalyst warm-up control while reducing the reduction in fuel economy due to the retardation of the target ignition timing.

The emission control system according to the fifth embodiment is configured to, when carrying out the engine-output increase control, cause the motor-generator 27 to generate a power level corresponding to an increase in the engine output to be used for the engine-output increase control. This prevents an increase in actual drive power for the hybrid vehicle relative to driver's required drive power due to the execution of the engine-output increase control. This prevents giving uncomfortable feelings to the driver.

The emission control system according to the fifth embodiment is configured to determine whether only execution of the heat-recovery decrease control permits required heat energy to be sufficiently supplied to the catalyst 33 in step S64. Upon determining that only execution of the heat-recovery decrease control permits the required heat energy to be sufficiently supplied to in step S64 (YES in step S64), the emission control system according to the fifth embodiment carries out the heat-recovery increase control without executing the engine-output increase control. This configuration reduces the chances of execution of the engine-output increase control, thus improving fuel economy.

The emission control system according to the fifth embodiment is configured to determine whether the power level corresponding to the increase in the engine output by the engine-output increase control is greater than the power level chargeable in the battery 26. Upon determining that the power level corresponding to the increase in the engine output by the engine-output increase control is greater than the power level chargeable in the battery 2 (YES in step S67), the microcomputer 18*a* carries out the catalyst warm-up control by executing the ignition retarding control to increase the temperature of the exhaust emissions without executing the engine-output increase control and the output-power increase control. Thus, it is possible to prevent an increase in actual drive power for the hybrid vehicle relative to driver's required drive power, thus reliably preventing giving uncomfortable feelings to the driver.

Sixth Embodiment

Figure 15:
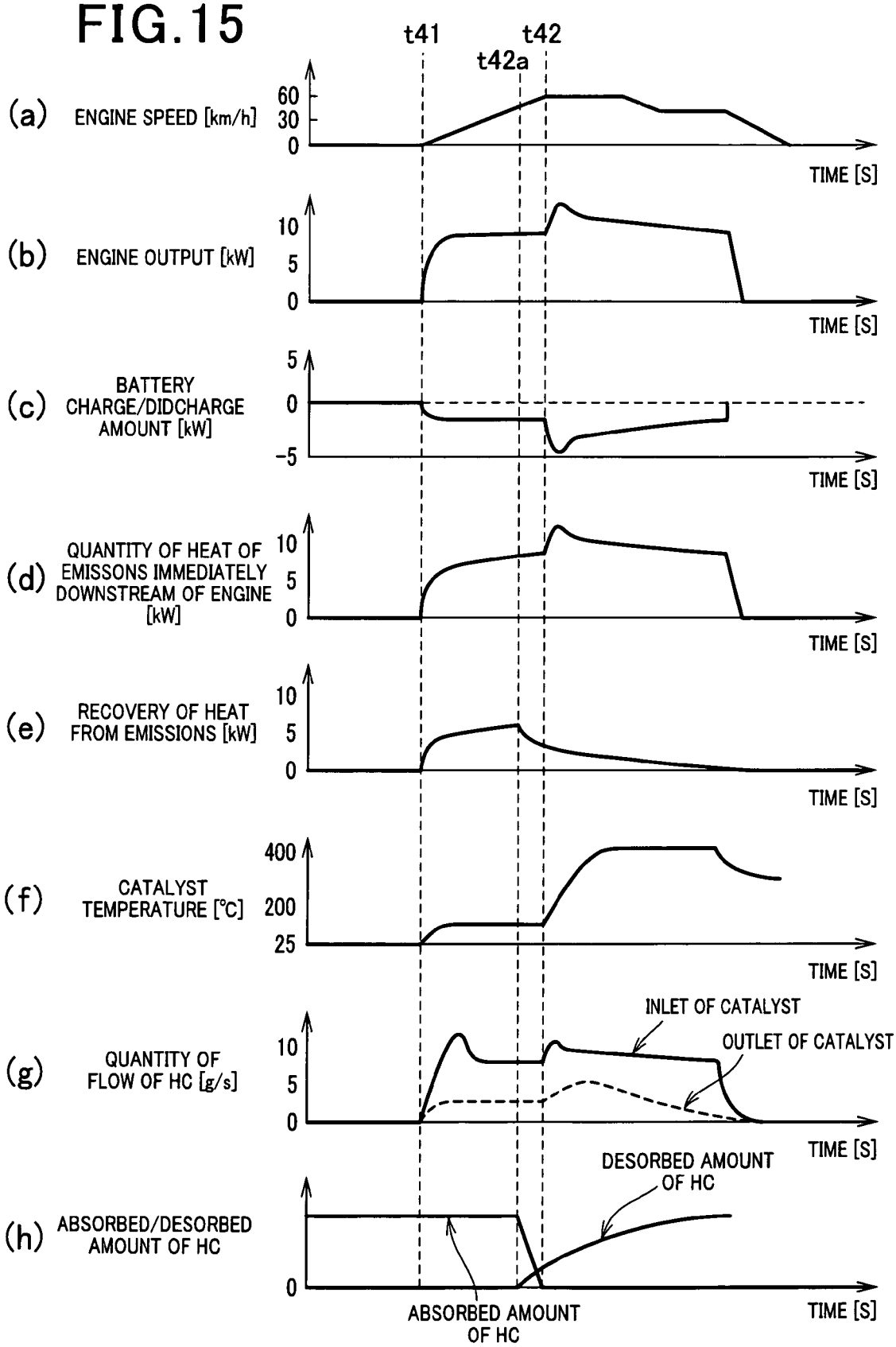
FIG. 15 is a timing chart schematically illustrating an example of the operations of the microcomputer illustrated in FIG. 13 according to the sixth embodiment of the present invention.

An emission control system according to the sixth embodiment of the present invention will be described hereinafter with reference to FIG. 15.

The structure and/or functions of the emission control system according to the sixth embodiment are different from the emission control system according to the fifth embodiment by the following points. So, the different points will be mainly described hereinafter.

The emission control system according to the fifth embodiment is configured to simultaneously carry out the heat-recovery decrease control, the engine-output increase control, and the output-power increase control in synchronization with the arrival of the absorbent temperature Ta to the desorbing temperature Ta.

However, the emission control system according to the sixth embodiment is configured to set the start timing of the heat-recovery decrease control earlier than that of each of the engine-output increase control and the output-power increase control.

As described above, the absorbent 32 strictly starts to desorb the absorbed HC at the desorbing start temperature lower than the desorbing temperature T1, but it is available for absorbing the HC at a temperature range lower than the desorbing temperature T1. Specifically, the absorbent 32 is available for absorbing and desorbing the HC with its temperature Ta being within a range from the desorbing start temperature of, for example, 100° C. to the desorbing temperature T1 of, for example, 150° C. The absorbent 32 is unavailable for absorbing the HC with its temperature Ta reaching the desorbing temperature T1. The HC absorption rate of the absorbent 32 is gradually reduced with increase in the absorbent temperature Ta that is within the temperature range, which is represented as 100° C.≤Ta<150° C. Thus, the emission control system according to the sixth embodiment is configured to set the start timing of the heat-recovery decrease control at time t42*a* when the absorbent temperature Ta reaches the desorbing start temperature, and set the start timing of each of the engine-output increase control and the output-power increase control at time t42 when the absorbent temperature Ta reaches the desorbing temperature T1 (see (h) of FIG. 15).

In this embodiment, the emission control system starts the heat-recovery decrease control earlier than time t42, thus facilitating early completion of the catalyst warm-up control. Note that, if the emission control system according to the sixth embodiment started the heat-recovery decrease control earlier than time t42*a* in contrast to the sixth embodiment, the timing at which the absorbent temperature Ta reaches the desorbing temperature T1 would be accelerated so that the amount of the HC to be absorbed in the absorbent 32 would not be sufficiently ensured. On the other hand, if the emission control system according to the sixth embodiment started the heat-recovery decrease control later than time t42*a*, the completion of the catalyst warm-up control would be delayed. To sum up, start of the heat-recovery decrease control at time t42*a* according to this embodiment allows the balance between the increase in the amount of the HC to be absorbed in the absorbent 32 and early completion of the catalyst warm-up control to be optimally determined.

The emission control system according to the sixth embodiment starts the engine-output increase control later than time t42*a*, thus reducing the deterioration of the exhaust emissions due to the engine-output increase control. Note that, if the emission control system according to the sixth embodiment started the engine-output control earlier than time t42 in contrast to the sixth embodiment, the timing at which the absorbent temperature Ta reaches the desorbing temperature T1 would be accelerated so that the amount of the HC to be absorbed in the absorbent 32 would not be sufficiently ensured. On the other hand, if the emission control system according to the sixth embodiment started the engine-output control earlier than the time later than time t42, the completion of the catalyst warm-up control would be delayed. To sum up, start of the engine-output control at time t42 according to this embodiment allows the balance between the increase in the amount of the HC to be absorbed in the absorbent 32 and early completion of the catalyst warm-up control to be optimally determined.

Seventh Embodiment

An emission control system according to the seventh embodiment of the present invention will be described hereinafter with reference to FIG. 16.

The structure and/or functions of the emission control system according to the seventh embodiment are different from the emission control system according to the fifth embodiment by the following points. So, the different points will be mainly described hereinafter.

The emission control system according to the fifth embodiment is configured to early out the output-power increase control as the load increase control. Specifically, the emission control system is configured to convert the increase in the engine output by the engine-output increase control into the output power of the motor-generator 27 that is driven based on the output of the engine 11, and charge the output power of the motor-generator 27 into the battery 26. In contrast, the emission control system according to the seventh embodiment is configured to carry out the following cooling-storage quantity increase control as the load increase control.

Figure 16:
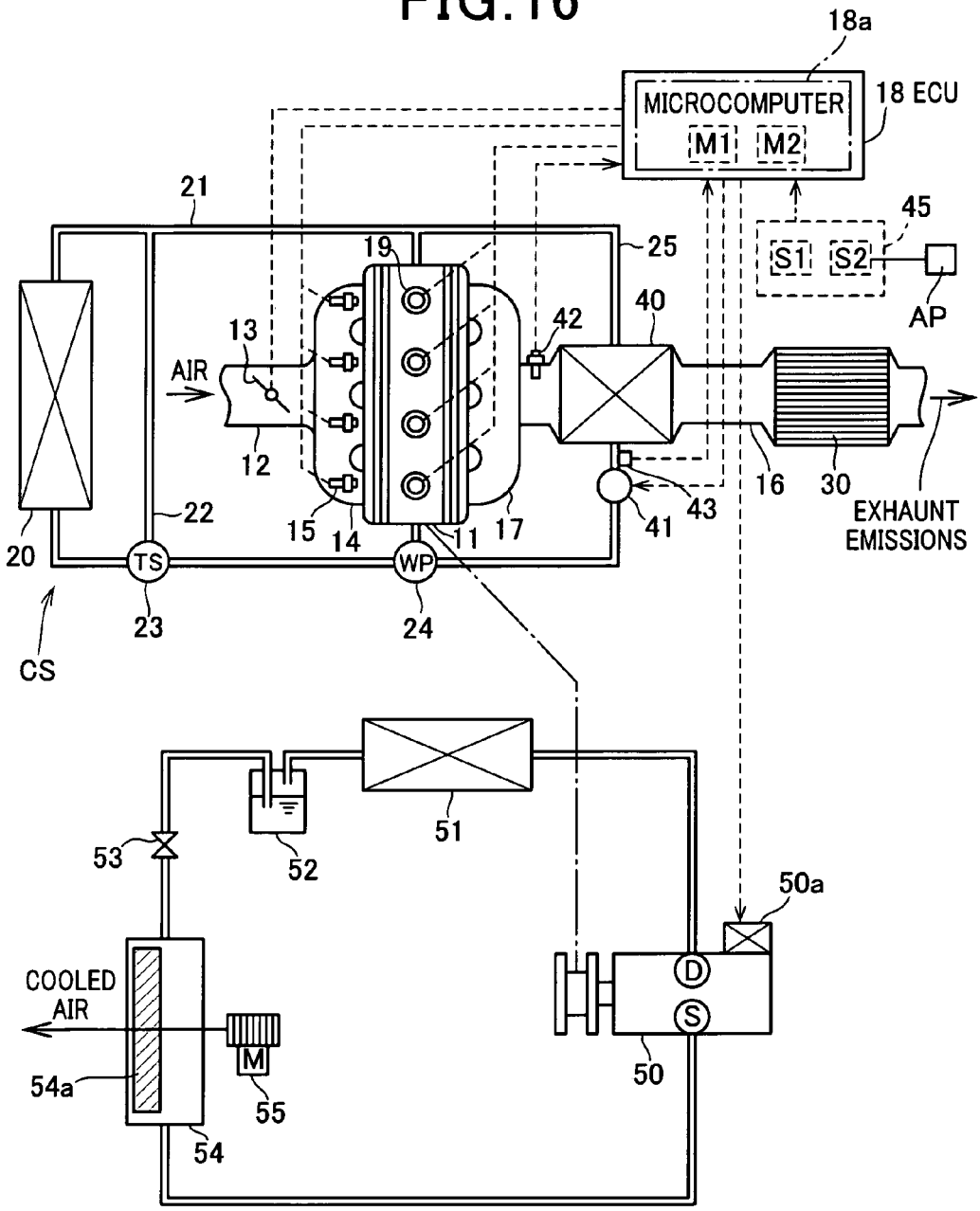
FIG. 16 is a structural view schematically illustrating an engine control system incorporating an emission control system according to the seventh embodiment of the present invention.

FIG. 16 schematically illustrates the overall structure of an engine control system according to the seventh embodiment. In the motor vehicle illustrated in FIG. 16, the engine control system and an air conditioner equipped with a refrigeration cycle containing a compressor 50 that is driven based on the engine output are installed. The compressor 50 is one of various devices that are driven based on the engine output. The compressor 50 is located on the refrigeration cycle and operative to receive refrigerant, and pumps the refrigerant to circulate the refrigerant through the refrigeration cycle.

The compressor 50 is equipped with a solenoid control valve 50*a*, and is designed as a variable capacity compressor. That is, adjustment of the opening of the solenoid control valve 50*a* under control of the ECU 18 allows the output capacity of the refrigerant to be continuously variable. During the rotation of the crankshaft CF being transferred to the compressor 50, drive of the solenoid control valve 50*a* adjusts the output capacity of the refrigerant. Note that the compressor 50 is driven with the output capacity of the refrigerant temperature being adjusted to zero.

The refrigerant compressed by the compressor 50 is cooled by heat exchange with ambient air by a condenser 51, and thereafter, is subjected to gas-liquid separation by a receiver 52. A liquid refrigerant in the receiver 52 is immediately expanded by an expansion valve 53, and thereafter, is evaporated. Air transferred from a blower fan 55 rotatably driven by a DC motor M is cooled by heat exchange with the refrigerant in the evaporator 54, and thereafter, blown out into the cabin as cool air.

The evaporator 54 comprises a sealed refrigerating agent, such as paraffin, 54*a*. The evaporated refrigerant in the evaporator 54 cools the refrigerating agent 54*a* so that cold thermal energy is stored in the evaporator 54. Specifically, drive of the compressor 50 allows heat exchange between the refrigerant supplied to the evaporator 54 and the refrigerating agent 54*a* so that cold thermal energy of the refrigerant is stored in the evaporator 54. Thereafter, heat exchange between air blown out from the blower fan 55 and the refrigerating agent 54*a* cools the air, and the cooled air is transferred into the cabin so that the cabin is cooled.

The microcomputer 18*a* of the ECU 18 according to the seventh embodiment is electrically connected to the solenoid control valve 50*a* and the DC motor M of the blower fan 55, and is operative to stop the operation of the blower fan 55 while increasing, for example, maximizing, the output capacity of the refrigerant for carry out the engine-output increase control.

This configuration drives the compressor 50 by the increase in the engine output by the engine-output increase control to thereby store cold thermal energy of the refrigerant in the refrigerating agent 54*a*. When cooling of the cabin is requested, the microcomputer 18*a* drives the blower fan 55 so that heat exchange between air blown out from the blower fan 55 and the refrigerating agent 54*a* cools the air. The cooled air is transferred into the cabin so that the cabin is cooled.

Note that, when the temperature of the evaporator 54 is lower than a preset temperature, water droplets onto the outer surface of the evaporator 54 are frosted, resulting in significant reduction of the heat-transfer efficiency. Thus, when the temperature of the evaporator 54 or the temperature of air downstream of the evaporator 54 is equal to or lower than a predetermined threshold temperature, the microcomputer 18*a* controls the solenoid control valve 50*a* to reduce the output capacity of the refrigerant, thus increasing the temperature of the evaporator 54 to be higher than the preset temperature. This prevents the water drops onto the outer surface of the evaporator 54 from being frosted.

While executing such frost prevention control, the microcomputer 18*a* may not drive the compressor 50 even when carrying out the engine-output increase control. In this case, as well as the affirmative determination in step S67, the microcomputer 18*a* disables the engine-output increase control, and carries out the catalyst warm-up control by executing the ignition retarding control to increase the temperature of the exhaust emissions without executing the engine-output increase control and the output-power increase control in the same manner as step S69.

The emission control system according to the seventh embodiment configured to carry out the cooling-storage quantity increase control as the load increase control achieves the same effects as those in the fifth embodiment.

The present invention is not limited to the descriptions of each of the first to seventh embodiments, and can be implemented as the following modifications of any one of the first to seventh embodiments. In addition, the present invention can be implemented by combining the technical structure of any one of the first to seventh embodiments with that of another one of the first to seventh embodiments.

In each of the first and second embodiments, the emission control system changes the quantity of flow of the coolant to be circulated to the heat exchanger 40 from its upper limit to zero in a step-like manner, but can change it depending on the heat-exchanger inlet temperature Tex or the coolant temperature Tw. This modification allows the catalyst temperature Tc at time t2 or t20 when it is determined that the heat-exchanger inlet temperature Tex is shifted from the low-temperature state to the high-temperature state to be higher than the temperature at time t2 or t20 illustrated in FIG. 4 or FIG. 6 with the catalyst temperature Tc being lower than the desorbing temperature T1. This reduces the time from the high-temperature state determining timing t2 or t20 to the completion of the catalyst warm-up control, thus facilitating early completion of the catalyst warm-up control.

In each of the first to seventh embodiments, the emission control device 30 integrally formed with the absorbent 32 and the catalyst 33 is used, but the present invention can be implemented as emission control devices separately formed with the absorbent 32 and the catalyst 33. In this modification, the absorbent is preferably located upstream of the catalyst in order to set the ambient temperature for the absorbent to be higher than that for the catalyst. This arrangement can reduce the period from the time at which the absorbent temperature Ta reaches the desorbing temperature T1 to the time at which the catalyst temperature reaches the activation temperature T2; this period represents dead period during which no absorption and oxidation are carried out.

In each of the first to seventh embodiments, the quantity regulating valve 41 is provided as means for regulating the quantity of flow of the coolant to be circulated to the heat exchanger 40, but the present invention is not limited to the configuration. If engines are configured such that the water pump 24 is driven by an electric motor, variable control of the driving speed of the water pump 24 can regulate the quantity of flow of the coolant to be circulated to the heat exchanger 40. Thus, when the present invention is applied to these engines, it is possible to eliminate the quantity regulating valve 41, and control the operations of the water pump 24 to regulate the quantity of flow to be circulated to the heat exchanger 40.

In each of the first and second embodiments, the emission control system comprises exhaust-gas state determining means (steps S10 and S15) and absorption-state determining means (step S30), but it can comprise only the absorption-state determining means (step S30).

This modification maximizes the quantity of flow of the coolant to be circulated to the heat exchanger 40 with the absorbent 32 being available for absorbing the HC immediately after the engine start-up to thereby blunt the rise in the temperature Tout of the exhaust emissions at the outlet of the heat exchanger 40 entering the emission control device 30. Thus, it is possible to lengthen the time until the absorbent temperature Ta reaches the desorbing temperature T1, and therefore to increase the amount of the HC to be absorbed in the absorbent 32. This makes full use of the absorption capabilities of the absorbent 32.

On the other hand, when the amount of the HC absorbed in the absorbent 32 exceeds its allowable amount to be saturated and/or the absorbent temperature Ta is equal to or higher than the desorbing temperature after the engine start-up so that the absorbent 32 becomes unavailable for absorbing the HC, the emission control system minimizes the quantity of flow of the coolant to be circulated to the heat exchanger 40 to zero to facilitate the rise in the rise in the temperature Tout of the exhaust emissions at the outlet of the heat exchanger 40 entering the emission control device 30. Thus, it is possible to reduce the period from the time at which the absorbent 32 becomes unavailable for absorbing the HC to the time at which the catalyst temperature Tc reaches the activation temperature T2, resulting in early completion of the catalyst warm-up control.

In each of the first to seventh embodiments, the HC is a particular component in the exhaust emissions as a target for purification, and the present invention is applied to the emission control system equipped with the absorbent and catalyst for absorbing the HC and oxidizing the absorbed HC. However, the present invention is not limited to the application.

Specifically, for lean-burn gasoline engines or diesel engines, the present invention can be applied to emission control systems equipped with an absorbent for absorbing the NOx as a particular component in the exhaust emissions and with a catalyst for oxidizing the absorbed NOx.

In each of the first to seventh embodiments, the heat exchanger 40 carries out heat exchange of the engine coolant flowing through the radiator 20 with the exhaust emissions, but can carry out heat exchange of the engine coolant with an alternative heat-transfer medium circulated by an electric pump, and carry out heat exchange of the alternative heat-transfer medium with the exhaust emissions.

When this modification is applied to each of the third and fourth embodiments, as the heat-recovery increase control, it is possible to increase the quantity of flow of the engine coolant to be circulated through the heat exchanger 40, increase the quantity of flow of the alternative heat-transfer medium to be circulated by the electric pump, or increase both of the quantity of flow of the engine coolant to be circulated through the heat exchanger 40 and the quantity of flow of the alternative heat-transfer medium to be circulated by the electric pump.

In each of the first to seventh embodiments, the emission control system is designed to adjust the opening of the quantity regulating valve 41 to thereby increase the recovery of heat from the exhaust emissions, but the present invention is not limited thereto. Specifically, an emission control system according to a modification of each of the first to seventh embodiments can be provided with a bypass pipe BP (see the phantom lines in FIG. 1). The bypass pipe BP is so connected to the exhaust pipe 16 as to allow the exhaust emissions out of the engine 11 to be supplied to the emission control device 30 while bypassing the heat exchanger 40. A switching valve SV is mounted on a connection point between the exhaust pipe 16 and the bypass pipe BP. The switching valve SV is operative to switch the flow of the exhaust emissions between the heat exchanger 40 and the bypass pipe BP. That is, for increasing the recover of heat from the exhaust gasses, the microcomputer 18*a* controls the switching valve SV to switch the flow of the exhaust emissions from the bypass pipe BP to the heat exchanger 40. This carries out the heat-recovery increase control.

The exhaust-emission temperature sensor 42 can be provided in emission control device 30 and operative to directly measure the temperature of the catalyst 33. The exhaust-emission temperature sensor 42 can be provided in the exhaust pipe 16 at the downstream of the heat exchanger 40, and the microcomputer 18*a* can be operative to calculate the catalyst temperature Tc and the absorbent temperature Ta based on a measured value of the exhaust-emission temperature sensor 42, the quantity of flow of the coolant to be circulated through the heat recovery pipe 25, and the operating conditions of the engine 11.

In the fourth embodiment, upon determining that the output power of the motor-generator 27 useable for the assist of the engine 11 from the battery 26 is less than the predetermined electric power corresponding to the reduction of the engine output (NO in step S57), the microcomputer 18*a* can carry out retardation of the target ignition timing in comparison to when the affirmative determination in step S57 is made. In each of the third and fourth embodiments, upon determining that the absorbent 32 is unavailable for absorbing the HC (NO in step S51 or NO in step S53), the microcomputer 18*a* can carry out retardation of the target ignition timing in comparison to when the affirmative determination in step S51 or S53 is made.

In each of the first to seventh embodiments, the microcomputer 18*a* can determine whether the amount of the HC absorbed in the absorbent 32 reaches the saturated amount by determination of whether an elapsed time after the start-up of the engine 11 reaches a preset time in the same manner as each of the first and second embodiments.

Specifically, the microcomputer 18*a* can determine whether the amount of the HC absorbed in the absorbent 32 reaches the saturated amount based on the history of a manipulated variable indicative of the position or stroke of the accelerator pedal AP of the motor vehicle during warming up of the engine 11 immediately after the start-up of the engine 11. For example, the microcomputer 18*a* can determine that the amount of the HC absorbed in the absorbent 32 reaches the saturated amount when an integrated value of the manipulated variable indicative of the position or stroke of the accelerator pedal AP exceeds a preset threshold value.

The microcomputer 18*a* can also determine whether the amount of the HC absorbed in the absorbent 32 reaches the saturated amount when an integrated value of the amount of heat supplied to the absorbent 32 reaches a preset value. For example, the microcomputer 18*a* can calculate a present amount of heat supplied to the absorbent 32 based on parameters of the operating conditions of the engine 11; these parameters include a present instructed quantity of fuel for each fuel injector, an present air-intake quantity, a present position or stroke of the accelerator pedal, which are associated with the engine load, a present engine speed, and a present quantity of flow of the coolant circulated to the heat exchanger 40. The microcomputer 18*a* can also determine whether the amount of the HC absorbed in the absorbent 32 reaches the saturated amount when the engine speed reaches a preset value.

In the fourth embodiment, the motor-generator 27 serving as a motor and a generator is used as an electric motor for assisting the engine 11, but an electric motor without having power generation function can be used as an electric motor for assisting the engine 11.

In each of the fifth to seventh embodiments, in step S69, the microcomputer 18*a* carries out the ignition retarding control while executing the engine-output increase control and the output-power increase control by the power level chargeable in the battery 26. This modification reduces an amount of retardation of the target ignition timing to thereby inhibit the reduction in fuel economy in comparison to cases where no engine-output increase control and no output-power increase control are carried out in FIG. 13.

While there has been described what is at present considered to be these embodiments and their modifications of the present invention, it will be understood that various modifications which are not described yet may be made therein, and it is intended to cover in the appended claims all such modifications as fall within the scope of the invention.

What is claimed is:

1. An emission control system comprising:

an absorbent provided in a passage through which an exhaust emission of an internal combustion engine flows, the exhaust emission containing a particular component, the absorbent acting to absorb the particular component with a temperature thereof being lower than a first temperature, the absorbent acting to desorb therefrom the absorbed particular component with the temperature thereof being equal to or higher than the first temperature;

a catalyst provided in the passage, the catalyst acting to convert the particular component desorbed from the absorbent into another component with a temperature thereof being equal to or higher than a second temperature, the second temperature being higher than the first temperature;

a heat recovery device disposed in the passage upstream of the absorbent and configured to recover heat from the exhaust emission by heat exchange between a heat-transfer medium and the exhaust emission;

an adjusting unit configured to adjust an amount of heat to be recovered by the heat recovery device to thereby adjust a temperature state of the exhaust emission;

a circulating unit configured to circulate the heat-transfer medium through the heat recovery device, wherein the adjusting unit is configured to adjust a quantity of flow of the heat-transfer medium to be circulated to the heat recovery device to thereby adjust the amount of heat to be recovered by the heat recovery device;

a temperature state determining unit configured to determine whether a temperature of the exhaust emission upstream of the heat recovery device is in a high-temperature state with the temperature of the exhaust emission being equal to or higher than the second temperature or a low-temperature state with the temperature of the exhaust emission being lower than the second temperature, wherein the adjusting unit is configured to adjust the quantity of flow of the heat-transfer medium to be circulated to the heat recovery device to a first value when it is determined that the temperature of the exhaust emission upstream of the heat recovery device is in the high-temperature state and to a second value when it is determined that the temperature of the exhaust emission upstream of the heat recovery device is in the low-temperature state, the first value being lower than the second value.

2. The emission control system according to claim 1, further comprising:

an absorption determining unit configured to determine whether the absorbent is available for absorbing the particular component, the adjusting unit being configured to, when it is determined that the absorbent is unavailable for absorbing the particular component, adjust the quantity of flow of the heat-transfer medium to be circulated to the heat recovery device to the second value independently of whether the temperature of the exhaust emission upstream of the heat recovery device is in the high-temperature state or the low temperature state.

3. The emission control system according to claim 1, further comprising:

an exhaust emission temperature sensor configured to measure the temperature of the exhaust emission upstream of the heat recovery device, the temperature state determining unit is configured to determine whether the temperature of the exhaust emission upstream of the heat recovery device is in the high-temperature state or the low-temperature state based on the temperature of the exhaust emission upstream of the heat recovery device measured by the exhaust emission temperature sensor.

4. The emission control system according to claim 1, further comprising:

a heat-transfer medium temperature sensor configured to measure the temperature of the heat-transfer medium, the temperature state determining unit is configured to determine whether the temperature of the exhaust emission upstream of the heat recovery device is in the high-temperature state or the low-temperature state based on the temperature of the heat-transfer medium measured by the heat-transfer medium temperature sensor.

5. The emission control system according to claim 1, further comprising:

an absorption determining unit configured to determine whether the absorbent is available for absorbing the particular component, wherein the adjusting unit is configured to adjust the quantity of flow of the heat-transfer medium to be circulated to the heat recovery device to a third value when it is determined that the absorbent is available for absorbing the particular component and to a fourth value when it is determined that the absorbent is unavailable for absorbing the particular component, the fourth value being lower that the third value.

6. The emission control system according to claim 5, wherein the absorption determining unit is configured to determine whether the absorbent is available for absorbing the particular component based on an elapsed time after start-up of the internal combustion engine.

7. The emission control system according to claim 5, wherein the absorption determining unit is configured to determine whether the absorbent is available for absorbing the particular component based on an operated amount of an accelerator pedal by an operator during a warm-up operation of the internal combustion engine.

8. The emission control system according to claim 5, wherein the absorption determining unit is configured to determine whether the absorbent is available for absorbing the particular component based on an integrated value of an amount of heat supplied to the absorbent after start-up of the internal combustion engine.

9. The emission control system according to claim 5, wherein the absorption determining unit is configured to determine whether the absorbent is available for absorbing the particular component based on a speed of the internal combustion engine during a warm-up operation of the internal combustion engine.

10. The emission control system according to claim 5, wherein the absorption determining unit is configured to determine whether the absorbent is available for absorbing the particular component based on the temperature of the absorbent.

11. The emission control system according to claim 1, further comprising:

a first determining unit configured to determine whether the absorbent and the catalyst are in warm-up request state in which the temperature of the absorbent is equal to or higher than the first temperature and the temperature of the catalyst is lower than the second temperature, the adjusting unit being configured to execute a first control to decrease the amount of heat to be recovered by the heat recovery device when it is determined that the absorbent and the catalyst are in the warm-up request state in comparison to that when it is determined that the absorbent and the catalyst are not in the warm-up request state;

an output increase unit configured to execute a second control to increase an output of the internal combustion engine when it is determined that the absorbent and the catalyst are in the warm-up request state in comparison to when it is determined that the absorbent and the catalyst are not in the warm-up request state; and a load increase unit configured to execute a third control to increase a load of a device that is driven by the output of the internal combustion engine when it is determined that the absorbent and the catalyst are in the warm-up request state in comparison to that when it is determined that the absorbent and the catalyst are not in the warm-up request state.

12. The emission control system according to claim 11, further comprising:

a second determining unit configured to determine whether execution of the first control without executing the second control when it is determined that the absorbent and the catalyst are in the warm-up request state permits heat energy to be supplied to the catalyst, the heat energy being required for the catalyst, the output increase unit being configured to execute the second control as long as it is determined that execution of the first control without executing the second control does not permit the required heat energy to be supplied to the catalyst.

13. The emission control system according to claim 11, wherein the device is a generator to be driven by the output of the internal combustion engine to generate power, and the generator is connected to a battery for charging the battery, further comprising:

a third determining unit configured to calculate a power level that would be generated by the generator based on the increase in the output of the internal combustion engine by the output increase unit if the second control were executed by the output increase unit, and to determine whether the calculated power level is chargeable in the battery based on a state of charge of the battery, the output increase unit being configured to execute the second control as long as it is determined that the calculated power level is chargeable in the battery based on a state of charge of the battery.

14. The emission control system according to claim 1, further comprising:

an absorption determining unit configured to determine whether the absorbent is available for absorbing the particular component, the adjusting unit being configured to execute a first control to increase the amount of heat to be recovered by the heat recovery device when it is determined that the absorbent is available for absorbing the particular component in comparison to that when it is determined that the absorbent is unavailable for absorbing the particular component; and an output decrease unit configured to execute a second control to decrease an output of the internal combustion engine when it is determined that the absorbent is available for absorbing the particular component in comparison to that when it is determined that the absorbent is unavailable for absorbing the particular component.

15. The emission control system according to claim 14, further comprising:

a first determining unit configured to determine whether execution of the first control without executing the second control when it is determined that the absorbent is available for absorbing the particular component permits holding a time interval during which the absorbent is available for absorbing the particular component, the time interval being equal to or longer than a preset time interval, the output decrease unit being configured to execute the second control as long as it is determined that execution of the first control without executing the second control when it is determined that the absorbent is available for absorbing the particular component does not permit holding the time interval.

16. The emission control system according to claim 14, wherein the emission control system is installed in a hybrid vehicle driven by an output of the internal combustion engine and an output of a motor, further comprising:

a motor-output increase unit configured to execute a third control to increase the output of the motor during the second control being executed in comparison to that during the second control being not executed.

17. The emission control system according to claim 16, further comprising:

a second determining unit configured to determine whether execution of the third control would be compensated for the decrease in the output of the internal combustion engine if the second control were executed by the output decrease unit, the output decrease unit being configured to execute the second control as long as it is determined that execution of the third control would be compensated for the decrease in the output of the internal combustion engine if the second control were executed by the output decrease unit.

* * * * *